US012727647B2

(12) United States Patent
Dietrich et al.

(10) Patent No.: US 12,727,647 B2
(45) Date of Patent: Sep. 8, 2026

(54) SHOE WITH IMPROVED HEEL SUPPORT

(71) Applicant: adidas AG, Herzogenaurach (DE)

(72) Inventors: Stephan Dietrich, Nuremberg (DE); Willem Van Beuningen, Herzogenaurach (DE); Criselda Ocuaman Virata, Herzogenaurach (DE); Cori Kristine Marble Steele, Portland, OR (US); David John Yong, Portland, OR (US); Christopher James Polster, Portland, OR (US); Ian James Hennebery, Portland, OR (US); Nicole Jean Demby, Portland, OR (US); Kathryn Ann Farina, Portland, OR (US)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 18/982,990

(22) Filed: Dec. 16, 2024

(65) Prior Publication Data

US 2025/0213000 A1 Jul. 3, 2025

Related U.S. Application Data

(63) Continuation-in-part of application No. 18/400,799, filed on Dec. 29, 2023.

(51) Int. Cl.

| | |
|---|---|
| ***A43B 23/07*** | (2006.01) |
| ***A43B 21/36*** | (2006.01) |
| ***A43B 23/28*** | (2006.01) |
| ***A43C 1/00*** | (2006.01) |
| ***A43C 5/00*** | (2006.01) |

(52) U.S. Cl.
CPC ..... *A43B 21/36* (2013.01); *A43B 23/07* (2013.01); *A43B 23/28* (2013.01); *A43C 1/003* (2013.01); *A43C 5/00* (2013.01)

(58) Field of Classification Search
CPC ..... A43B 23/07; A43B 23/28; A43B 7/14; A43C 1/003
USPC ..... 36/50.1, 105
See application file for complete search history.

(56) References Cited

U.S. PATENT DOCUMENTS

| | | | | |
|---|---|---|---|---|
| D35,490 | S | 12/1901 | Hatiieway | |
| 796,258 | A | 8/1905 | Scott | |
| 1,114,435 | A | 10/1914 | Batten | |
| 1,545,623 | A * | 7/1925 | Westfall | A43B 5/025 36/89 |
| D158,653 | S | 5/1950 | Fenlason | |
| 2,531,763 | A | 11/1950 | Andre | |
| 2,994,972 | A | 8/1961 | Blair | |

(Continued)

FOREIGN PATENT DOCUMENTS

| | | |
|---|---|---|
| EP | 2424398 B1 | 12/2015 |
| IT | 102012902050195 | 11/2013 |

(Continued)

*Primary Examiner* — Marie D Bays
(74) *Attorney, Agent, or Firm* — Sterne, Kessler, Goldstein & Fox P.L.L.C.

(57) ABSTRACT

Shoes, in particular sports shoes, that comprise an upper and a heel element arranged to at least partially overlap with at least a part of the upper. The heel element is configured to envelop at least a part of a heel of a wearer of the shoe and is movable with respect to the upper. The movable arrangement between the heel element and the upper allows the wearer to adjust the fit of the shoe.

18 Claims, 16 Drawing Sheets

(56) References Cited

U.S. PATENT DOCUMENTS 3,134,179 A * 5/1964 Laham ..... A43C 1/00 D2/900
3,258,862 A 7/1966 Minor et al.
3,327,410 A * 6/1967 Park, Sr. ..... A43B 5/02 36/114
3,703,775 A 11/1972 Gatti
4,064,642 A 12/1977 Vykukal et al.
4,245,408 A * 1/1981 Larsen ..... A43C 11/004 36/114
5,184,410 A 2/1993 Hamilton
5,271,130 A 12/1993 Batra
D343,277 S 1/1994 Richard et al.
5,291,671 A 3/1994 Caberlotto et al.
5,319,869 A * 6/1994 McDonald ..... A43B 23/0235 36/114
D348,977 S 7/1994 Koh
D358,021 S 5/1995 Vestuti
5,425,185 A 6/1995 Gansler
5,463,822 A 11/1995 Miller
5,467,537 A 11/1995 Aveni et al.
D365,438 S 12/1995 Orzeck
5,497,564 A 3/1996 Allen et al.
D368,799 S 4/1996 Lozano
5,511,325 A 4/1996 Hieblinger
5,557,866 A 9/1996 Prengler
5,564,203 A 10/1996 Morris
5,570,523 A 11/1996 Lin
5,651,195 A 7/1997 Clancy
5,659,982 A 8/1997 Muraoka et al.
D384,494 S 10/1997 Clancy
5,755,044 A 5/1998 Veylupek
5,813,144 A 9/1998 Prengler
5,836,090 A 11/1998 Smith
5,943,793 A * 8/1999 Clements ..... A43C 5/00 36/89
5,946,827 A * 9/1999 Okajima ..... A43B 7/1495 36/117.6
5,966,841 A * 10/1999 Barret ..... A43B 5/04 36/50.1
6,119,372 A 9/2000 Okajima
6,128,835 A * 10/2000 Ritter ..... A43C 1/00 36/114
D441,175 S 5/2001 Ritter et al.
6,374,516 B1 4/2002 Bonaventure et al.
7,793,438 B1 9/2010 Busse et al.
8,215,036 B2 7/2012 Auger et al.
8,984,719 B2 3/2015 Soderberg et al.
8,997,380 B2 4/2015 Dombrow et al.
9,149,089 B2 10/2015 Cotterman et al.
9,179,729 B2 11/2015 Cotterman et al.
9,237,778 B2 1/2016 Cook et al.
9,408,437 B2 8/2016 Goodman et al.
9,414,640 B2 8/2016 Nichols
9,480,299 B2 11/2016 Dinndorf et al.
9,516,923 B2 12/2016 Capra et al.
9,610,185 B2 4/2017 Capra et al.
9,743,714 B2 8/2017 Hammerslag et al.
9,770,070 B2 9/2017 Cotterman et al.
9,854,873 B2 1/2018 Kerns et al.
10,039,348 B2 8/2018 Cavanagh et al.
10,070,695 B2 9/2018 Burns et al.
D840,663 S 2/2019 Flanagan et al.
10,271,616 B2 4/2019 Labbe
10,327,513 B2 6/2019 Soderberg et al.
10,342,294 B2 7/2019 Lovett et al.
10,413,020 B2 9/2019 Beers et al.
10,602,797 B2 3/2020 Lintaman
10,687,586 B2 6/2020 Sullivan
10,702,409 B2 7/2020 Burns et al.
10,765,175 B2 9/2020 Panian et al.
10,863,796 B2 12/2020 Soderberg et al.
10,912,348 B2 2/2021 Owings et al.
10,959,486 B2 3/2021 Shah
11,058,182 B2 7/2021 Hull
11,122,861 B2 9/2021 Tresser
11,134,746 B2 10/2021 Seid
11,185,129 B2 11/2021 Dyer et al.
11,191,320 B2 12/2021 Happen
11,253,023 B2 2/2022 Hatfield et al.
11,291,266 B2 4/2022 Bird et al.
11,297,903 B2 4/2022 Soderberg et al.
11,445,781 B2 9/2022 Hopkins et al.
11,452,342 B2 9/2022 Hammerslag et al.
11,490,675 B2 11/2022 Dyer et al.
RE49,358 E 1/2023 Neiley et al.
11,553,761 B2 1/2023 Drake
11,602,199 B2 * 3/2023 Itskowitz ..... A43B 3/30
11,612,216 B2 3/2023 Beers et al.
11,666,115 B2 6/2023 Blanche et al.
11,684,109 B2 * 6/2023 Hatfield ..... A43B 3/242 36/105
11,700,916 B2 7/2023 Kilgore et al.
2002/0095823 A1 7/2002 Laio et al.
2003/0200680 A1 10/2003 Chang
2004/0098883 A1 * 5/2004 Clafton ..... A43C 11/14 36/88
2004/0250452 A1 * 12/2004 Farys ..... A43B 7/12 36/89
2009/0126225 A1 5/2009 Jarvis
2011/0010964 A1 1/2011 Hardy et al.
2012/0079746 A1 * 4/2012 Ferreira ..... A43C 1/02 36/105
2012/0117825 A9 5/2012 Jarvis
2012/0204450 A1 8/2012 Girbaud
2012/0216422 A1 8/2012 Ikezawa et al.
2012/0240428 A1 9/2012 Knoll
2013/0185959 A1 7/2013 Coleman
2014/0020191 A1 1/2014 Jones et al.
2014/0026773 A1 1/2014 Miller
2014/0029030 A1 1/2014 Miller
2014/0299009 A1 10/2014 Miller et al.
2014/0300675 A1 10/2014 Miller et al.
2014/0300676 A1 10/2014 Miller et al.
2015/0216252 A1 8/2015 Wiens
2015/0223553 A1 8/2015 Ardell et al.
2015/0223554 A1 8/2015 Ardell et al.
2018/0199659 A1 * 7/2018 Lintaman ..... A43C 11/146
2018/0213882 A1 8/2018 Morse
2018/0235314 A1 8/2018 Farage
2018/0338562 A1 11/2018 Hatfield et al.
2018/0338566 A1 11/2018 Hatfield et al.
2018/0338583 A1 11/2018 Sullivan
2019/0313742 A1 10/2019 Bell et al.
2020/0205512 A1 7/2020 Blanche et al.
2021/0093046 A1 * 4/2021 Lam ..... A43C 1/003
2021/0244126 A1 8/2021 Chang et al.
2021/0282495 A1 9/2021 Davis et al.
2022/0007790 A1 * 1/2022 Moretti Polegato ..... A43B 23/0205
2022/0240625 A1 8/2022 Shin
2023/0077572 A1 3/2023 Dean et al.
2023/0218044 A1 * 7/2023 Itskowitz ..... A43C 11/14 36/50.1
2023/0263270 A1 * 8/2023 Jones ..... A43C 11/1493 36/105
2023/0284748 A1 9/2023 Weeks et al.
2023/0389649 A1 12/2023 Poëll
2024/0138517 A1 5/2024 Obedian

FOREIGN PATENT DOCUMENTS

WO WO-2010126708 A2 11/2010
WO WO-2013044013 A1 3/2013
WO WO-2014008331 A2 1/2014
WO WO-2014015037 A2 1/2014
WO WO-2015002521 A1 1/2015

* cited by examiner

SHOE WITH IMPROVED HEEL SUPPORT

This application claims priority to U.S. patent application Ser. No. 18/400,799, filed Dec. 29, 2023, which is incorporated herein in its entirety by reference thereto.

TECHNICAL FIELD

The present disclosure relates to a shoe with an improved heel support.

BACKGROUND

Shoes need to provide sufficient support to a foot of a wearer. This is particularly important for sports shoes such as running, basketball, tennis or training shoes which are subject to sudden stops, acceleration, cut movements, jumps etc. To this end, shoes comprise a shoe upper to receive a foot, to couple the foot to the sole structure of the shoe and to support the foot. Another important aspect is the correct size, width and shape of the shoe, which needs to be as close as possible to the size, width and shape of the foot to provide for a snug fit.

However, the sizes, widths and shapes of industrially manufactured shoes are usually only available at some level of quantization such that some wearers are often in between two available sizes, widths and/or shapes. To some degree, this can be compensated by laces, straps, hook-and-loop fasteners or similar fastening mechanisms that allow the wearer to tighten the upper. However, such fastening mechanisms usually only target the instep portion or dorsum of the foot. Thus, even if the wearer tightens the fastening mechanism, the heel of the foot may still not be sufficiently secured. As the heel may slip inside the shoe the wearer might perceive the shoe as loose although the fastening mechanism exerts some considerable amount of pressure. This may cause discomfort and friction, which might lead to blisters and decrease performance over time.

Thus, there is room for improving the fit of shoes, in particular sports shoes, given that no foot is similar and that industrially manufactured shoes can only provide a limited variety of sizes, widths and shapes.

BRIEF SUMMARY

Embodiments of the present disclosure comprise a shoe comprising an upper and movable heel element arranged to at least partially overlap with at least a part of the upper. The heel element is configured to envelop at least a part of a heel of a wearer of the shoe and is movable with respect to the upper. The movable arrangement between the heel element and the upper allows the wearer to adjust the fit of the shoe. In some embodiments, the wearer may adjust the fit of the shoe by pulling on a lace of the shoe. By way of example, and not limitation, the disclosure herein contemplates at least the following embodiments.

A first embodiment (I) of the present application is directed to a shoe (18), in particular a sports shoe, comprising an upper (1); and a heel element (2) arranged at least partially overlapping with at least a part of the upper (1), wherein the heel element (2) is configured to envelop at least a part of a heel of a wearer of the shoe, and the heel element (2) is movable with respect to the upper (1).

In a second embodiment (II), the upper (1) according to the first embodiment (I) does not comprise a heel portion.

In a third embodiment (III), the heel element (2) according to the first embodiment (I) or the second embodiment (II) overlaps with the upper (1) at a lateral and a medial side of the upper (1), in particular, the heel element (2) only overlaps with the upper (1) at a lateral and a medial side of the upper (1).

In a fourth embodiment (IV), the upper (1) according to the first embodiment (I) or the third embodiment (III) comprises a heel portion (3) and the heel element (2) is arranged inside of the upper.

In a fifth embodiment (V), the heel element (2) according to the third embodiment (III) or the fourth embodiment (IV) comprises an inward facing surface and an opposing outward facing surface, wherein a majority of the outward facing surface is not connected to the heel portion (3) of the upper (1) such that a void (4) is formed between the outward facing surface of the heel element (2) and the heel portion (3) of the upper (1).

In a sixth embodiment (VI), the heel element (2) according to any one of embodiments (I)-(V) defines a rim portion (5) and at least a section of the rim portion (5) connects the heel element (2) to the remaining part of the shoe.

In a seventh embodiment (VII) the rim portion (5) according to the sixth embodiment (VI) is connected to the upper (1) and/or a strobel board (6) and/or an insole and/or a midsole and/or an outsole of the shoe.

In an eighth embodiment (VIII), the rim portion (5) according to the sixth embodiment (VI) or the seventh embodiment (VII) connects the heel element (2) to the remaining part of the shoe by a plurality of stitches, an adhesive, and/or a weld.

In a ninth embodiment (IX), the heel element (2) according to any one of embodiments (I)-(VIII) comprises a textile material.

In a tenth embodiment (X), the heel element (2) according to any one of embodiments (I)-(IX) comprises an upper portion (9*a*) and a lower portion (9*b*) and, the lower portion (9*b*) is arranged closer to a sole of the shoe than the upper portion (9*a*).

In an eleventh embodiment (XI), the lower portion (9*b*) according to the tenth embodiment (X) comprises a higher stretchability than the upper portion (9*a*).

In a twelfth embodiment (XII), the upper portion (9*a*) according to the tenth embodiment (X) or the eleventh embodiment (XI) is filled with a cushioning material (15).

In a thirteenth embodiment (XIII), the cushioning material (15) according to the twelfth embodiment (XII) is a foam material.

In a fourteenth embodiment (XIV), the upper portion (9*a*) according to any one of embodiments (X)-(XIII) comprises a mesh material.

In a fifteenth embodiment (XV), the heel element (2) according to any one of embodiments (I)-(XIV) is coupled to a lace (10) of the shoe.

In a sixteenth embodiment (XVI), the heel element (2) according to the fifteenth embodiment (XV) is configured for receiving the lace (10) of the shoe at different positions on the heel element (2).

In a seventeenth embodiment (XVII), the heel element (2) according to the sixteenth embodiment (XVI) comprises one or more loops (11*a*, 11*b*, 11*c*) and/or lugs and/or punch holes on opposing sides of the heel element (2) for receiving the lace (10).

In an eighteenth embodiment (XVIII), the lace (10) according to any one of embodiments (XV)-(XVII) passes from a first eyelet of the upper (1) via a first eyelet of the heel element (2) to a second eyelet of the upper (1).

In a nineteenth embodiment (XIX), the first eyelet of the upper (1) according to the eighteenth embodiment (XVIII) is located on a first side of the shoe (18), and the first eyelet of the heel element (2) and the second eyelet of the upper (1) according to the eighteenth embodiment (XVIII) are located on a second side of the shoe (18) opposite the first side.

In a twentieth embodiment (XX), the eyelets of the upper (1) according to the eighteenth embodiment (XVIII) or the nineteenth embodiment (XIX) and/or the eyelet of the heel element (2) according to the eighteenth embodiment (XVIII) or the nineteenth embodiment (XIX) are loops, webbings (28), lugs or punch holes.

In a twenty-first embodiment (XXI), the shoe according to any one of embodiments (I) or (III)-(XX) further comprises a flap (13) connecting the heel portion (3) of the upper and the heel element (2).

In a twenty-second embodiment (XXII), the heel element (2) according to embodiment (XV) comprises a fulcrum (35) for receiving the lace (10) and the fulcrum (35) is configured to provide a lever for moving the heel element (2) relative to the upper (1) when a wearer pulls lace (10).

In a twenty-third embodiment (XXIII), the lace (10) according to embodiment (XXII) passes from an eyelet (38) of the upper (1), via a lace guide (37) of the heel element (2), to the fulcrum (35).

In a twenty-fourth embodiment (XXIV), the heel element (2) according to any one of embodiments (I)-(XXIII) comprises a monolithic, additively-manufactured component.

BRIEF DESCRIPTION OF THE FIGURES

Embodiments of the present disclosure will be described in more detail with reference to the following figures. Together with the description, the Figures further serve to explain the principles of and to enable a person skilled in the relevant art(s) to make and use the disclosed embodiments. These Figures are intended to be illustrative, not limiting. Although the disclosure is generally described in the context of these embodiments, it should be understood that it is not intended to limit the scope of the disclosure to these particular embodiments. In the Figures, like reference numbers indicate identical or functionally similar elements.

DETAILED DESCRIPTION

Figure 1A:
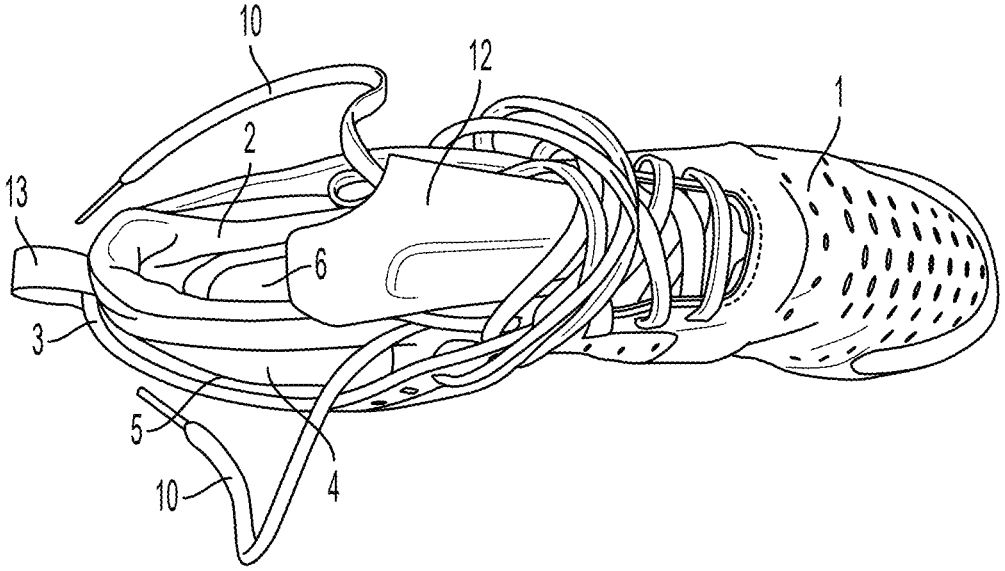
FIGS. 1A-D show an upper and a heel element arranged in the upper for a shoe according to some embodiments.

The indefinite articles "a," "an," and "the" include plural referents unless clearly contradicted or the context clearly dictates otherwise.

The term "comprising" is an open-ended transitional phrase. A list of elements following the transitional phrase "comprising" is a non-exclusive list, such that elements in addition to those specifically recited in the list can also be present. The phrase "consisting essentially of" limits the composition of a component to the specified materials and those that do not materially affect the basic and novel characteristic(s) of the component. The phrase "consisting of" limits the composition of a component to the specified materials and excludes any material not specified.

Embodiments of the present disclosure are described in detail herein with reference to embodiments thereof as illustrated in the accompanying drawings, in which like reference numerals are used to indicate identical or functionally similar elements. References to "one embodiment," "an embodiment," "some embodiments," "in certain embodiments," etc., indicate that the embodiment described can include a particular feature, structure, or characteristic, but every embodiment can not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

In the following, only some possible embodiments of the disclosure are described in detail. However, the present disclosure is not limited to these, and a multitude of other embodiments are applicable without departing from the scope of the disclosure. The presented embodiments can be modified in a number of ways and combined with each other whenever compatible and certain features may be omitted in so far as they appear dispensable. In particular, the disclosed embodiments may be modified by combining certain features of one embodiment with one or more features of another embodiment.

It is to be understood that not all features of the described aspects/embodiments must be present for realizing the technical advantages provided by the present disclosure, which is defined by the subject matter of the claims. The disclosed aspects/embodiments may be modified by combining certain features of one aspect/embodiment with one or more features of another aspect/embodiment. Specifically, the skilled person will understand that features, and/or functional elements of one aspect/embodiment can be combined with technically compatible features, and/or functional elements of any other aspect/embodiment of the present disclosure given that the resulting combination falls within the definition of the present disclosure.

Throughout the present figures and specification, the same reference numerals refer to the same elements. For the sake of clarity and conciseness, certain aspects of components or steps of certain embodiments are presented without undue detail where such detail would be apparent to those skilled in the art in light of the teachings herein and/or where such detail would obfuscate an under-standing of more pertinent aspects of the embodiments.

As understood by the skilled person and/or in order to avoid redundancies, reference is also made to the explanations in the preceding sections, which also apply to the following detailed description. Further, not all features, parts, elements, aspects, components and/or steps are expressly indicated by reference signs for the sake of brevity and clarity. This particularly applies, where the skilled person recognizes that such features, parts, elements, aspects, components and/or steps are present in a plurality.

Embodiments of the present disclosure provide an improved heel support for a shoe, in particular a sports shoe, comprising an upper and a heel element arranged at least partially overlapping with at least a part of the upper. The heel element is configured to envelop at least a part of a heel of a wearer of the shoe and the heel element is movable with respect to the upper. The relative movement the heel element and the upper can allow a wearer to adjust the fit of the shoe. And by allowing the wearer to adjust the fit of the shoe, the heel support allows the wearer to improve the fit of the shoe to their particular foot shape and size. This improvement can lead to improved performance of the footwear, for example, improvements in foot support during athletic actives and/or improvements in preventing foot irritation (for example, blisters).

These advantages, as well as others discussed herein, can overcome problems or disadvantages of prior art shoes. These advantages are achieved by the shoes described herein, and in particular by the subject matter of the independent claims. Exemplary embodiments of the present disclosure are described herein. At least some of the exemplary embodiments are defined in the dependent claims.

"Element" in the context of the present disclosure encompasses soft structures which are for example based on textiles, but also more rigid structures which are based on molded plastic elements. Combinations of multiple materials with different properties are also possible.

Shoes according to embodiments of the present disclosure comprise a heel element that surrounds, covers and secures the heel of a wearer. Because the heel element is movable relative to the upper, the heel element can adapt to the size, width and shape of the foot. In this way, a snug fit is provided, and the heel element is adaptable to feet of different sizes, width and/or shapes. Thus, shoes according to the present disclosure overcome the disadvantages of prior art shoes regarding fit and adaptability, at least partially.

For example, the heel elements as described herein may be applied to basketball shoes. Traditional basketball shoes have a static heel with zero adjustability in the heel pocket. Embodiments of the present disclosure specifically provide lockdown and agility. It is common for basketball players to wear shoes that are a size or two too large to accommodate ankle braces. Embodiments of the present disclosure feature a self-adjusting decoupled heel element that reduces in-shoe movement and provides a customized fit that adapts to each individual athlete. The adaptable or articulating heel element accommodates personal support needs (e.g., ankle braces) while maintaining low cut for agile gameplay. Although basketball shoes is a possible application, embodiments of the present disclosure may be applied to any sport.

In some embodiments, the upper may not comprise a heel portion. Rather, in such embodiments, the heel element fulfills the function of the heel portion. As the movement of the heel element is not restricted by a heel portion of the upper, it may optimally adapt to the foot.

The heel element may overlap with the upper at a lateral and a medial side of the upper. In some embodiments, the heel element may only overlap with the upper at a lateral and a medial side of the upper. The lateral and medial portions of the upper overlapping with the heel element may provide some lateral and medial guidance to the heel element.

In some embodiments, the upper may comprise a heel portion and the heel element may be arranged inside of the upper. In such embodiments, the heel portion of the upper provides additional support and protects the sensitive heel of the wearer.

The heel element may comprise an inward facing surface and an opposing outward facing surface. In some embodiments, a majority of the outward facing surface is not connected to the heel portion of the upper such that a void is formed between the outward facing surface of the heel element and the heel portion of the upper. Due to this arrangement, the heel element is movable even in embodiments where it is covered by a heel portion of the upper.

As used herein, an upper and heel element described as "not connected" to each other means that the upper and heel element are not fixedly joined in a plane in which they coextend such that the upper and heel element can move relative to each other. In some embodiments, the relative movement between the upper and heel element may comprise a sliding movement of the heel element relative to the upper, a pivoting movement of the heel element relative to the upper, or both.

In some embodiments, the relative movement between the upper and heel element can be activated by pulling on the lace of the shoe. In some embodiments, the relative movement between the between the upper and heel element can reduce a distance between a lace eyelet on the heel element and a lace eyelet of the upper. As described herein, in some embodiments, this change in distance can be created by a wearer pulling on a lace of the shoe. This change in distance can provide lock down of a wearer's heel by pulling the heel element forward.

"Inward facing" in the context of the present disclosure is to be understood as facing a foot of a wearer wearing the shoe. In contrast, "outward facing" in the context of the present disclosure denotes the opposite direction, i.e., away from the foot.

The void formed between the outward facing surface of the heel element and the heel portion of the upper in the context of the present disclosure means that one can separate the heel portion from the heel element, for example by inserting a finger in between. The presence of the void does not necessarily mean that the heel element and the heel portion of the upper do not abut each other. For example, during use of the shoe, the heel of a foot of a wearer may push the heel element against the heel portion of the upper. This may depend on the size of the foot compared to the size of the shoe, and for example on the type of movement the wearer performs.

The heel element may define a rim portion and at least a section of the rim portion may connect the heel element to a remaining part of the shoe. In some embodiments, the section of the rim portion of the heel element may be connected to the strobel board of the shoe and a rim portion of the upper. In some, the section of the rim portion of the heel element may only connected to the strobel board of the shoe. In any event, the heel element may be firmly coupled with the remaining part of the shoe at the rim portion while it nevertheless freely floats inside the shoe. In some embodiments, the rim portion may be connected to the upper and/or a strobel board and/or an insole and/or a midsole and/or an outsole of the shoe. Thus, the heel element may be connected at its bottom side, i.e., the side facing the ground, to the remaining part of the shoe. Therefore, the foot is firmly coupled to the shoe, especially for example during the terminal stance or heel-off phase of the gait cycle.

The rim portion may connect the heel element to the remaining part of the shoe by a plurality of stitches, an adhesive, and/or a weld. In this way, a firm and permanent connection is achieved.

In some embodiments, the heel element may comprise a textile material. A textile material is perceived as soft and provides a comfortable feel to the foot. In addition, it may help to wick away moisture from the foot.

The heel element may comprise an upper portion and a lower portion and the lower portion may be arranged closer to a sole of the shoe than the upper portion. In such embodiments, the heel element is divided in two portions, which may provide different functions to targeted areas of the foot.

In some embodiments, the lower portion of the heel element may comprise a higher stretchability than the upper portion. In such embodiments, the lower portion of the heel element may adapt to the heel of the foot and provide an improved fit.

In some embodiments, the upper portion of the heel element may be filled with a cushioning material. In this way, the sensitive Achilles heel is protected, and the wearing comfort increased. In addition, it creates a snug fit around the foot.

In some embodiments, the cushioning material may comprise a foam material. A foam material provides the necessary cushioning effect and is simple to process during manufacturing. For example, the foam material may be provided as a pre-formed insert.

In some embodiments, the upper portion of the heel element may comprise a mesh material. A mesh material comprises a plurality of holes or apertures that provide ventilation. In addition, a mesh material is sufficiently stretch resistant to secure the heel of the foot in the shoe. In some embodiments, the upper portion may comprise a reinforcement material added to supplement the structure and/or strength of the mesh material. The upper portion of the heel element may additionally or alternatively comprise a knitted fabric, leather, a woven material, synthetic leather, or any combination thereof.

The heel element may be coupled to a lace of the shoe. Thus, a wearer of the shoe can tighten the lace to activate the heel element as described herein to snugly wrap around the heel. Depending on the force exerted during tightening the lace, the pressure exerted by the heel element onto the heel can be adjusted according to the wearer's needs.

In some embodiments, the heel element may be configured for receiving the lace of the shoe at different positions on the heel element. For example, in a first position, the heel element is generally arranged closer to the heel portion of the upper, whereas in a second position, the heel element may be arranged closer to a tongue portion of the upper. In this way, the fit of the shoe can be adapted to the individual foot size and/or foot shape of the wearer.

The heel element may comprise one or more lace eyelets (for example, loops and/or lugs and/or punch holes) on opposing sides of the heel element for receiving the lace. By threading the lace through one of the lace eyelets, the heel element is firmly coupled to the tongue area of the shoe. By selecting an appropriate lace eyelet, the position of the heel element relative to the shoe upper can be adjusted to compensate for the individual foot size or shape and to obtain a snug fit.

In some embodiments, the lace may pass from a first eyelet of the upper via a first eyelet of the heel element to a second eyelet of the upper. In this way, when the lace is pulled for tightening the shoe, the heel element is activated, moves towards the heel of the wearer and locks down the heel. In such embodiments, the first eyelet of the upper may be located on a first side of the shoe, and the first eyelet of the heel element and the second eyelet of the upper may be located on a second side of the shoe opposite the first side. In this way, the heel element may be integrated in a cross lacing which is easy to fasten and unfasten and provides for a secure fit. The eyelets of the upper and/or of the heel element may be loops, webbings, lugs, or punch holes, or any other structure suitable for securing a shoelace on a shoe.

In some embodiments, the lace may pass from a first eyelet of the upper via a lace guide of the heel element to a fulcrum of the heel element and then to a second eyelet of the upper. In this way, when the lace is pulled for tightening, the heel element is activated, moves towards the heel of the wearer and locks down the heel. In such embodiments, the lace guide may be configured to position the lace along the heel element at an angle relative to the fulcrum such that the fulcrum provides optimal leverage when the lace is pulled by the wearer. In this way, the heel element may be easily articulated towards the wearer's heel and provide a secure fit.

In some embodiments, the shoe may comprise a flap connecting the heel portion of the upper and the heel element. In such embodiments, a wearer of the shoe can grab the flap when putting on the shoe to generally pull the shoe towards the foot but also to pull the heel element towards the heel portion of the shoe upper so as to facilitate inserting the foot.

In some embodiments, the heel element may comprise a plurality of apertures. In this way, ventilation of the foot is accomplished, which generally adds to the wearing comfort.

In some embodiments, the heel element may be manufactured from an additive manufacturing technique. In such embodiments, the heel element may comprise a monolithic, additively-manufactured component.

FIGS. 1A-D show a shoe upper 1 and a heel element 2 for a shoe according some embodiments. The shoe in this example is a sports shoe and comprises a sole (not shown in the figures) which would be attached to the bottom side of the upper 1. Generally, embodiments of the present disclosure are applicable to a variety of sports including training, such as high intensity interval training, running and basketball, which is a non-limiting list.

The heel element 2 is arranged inside of the upper 1 and in an overlapping manner with at least a part of a heel portion 3 of the upper 1. The heel element 2 is configured to envelop at least a part of a heel of a wearer of the shoe. As such, the heel element 2 comprises an inward facing surface and an opposing outward facing surface. The inward facing surface would be facing a foot of a wearer wearing the shoe. The outward facing surface would be facing in the opposite direction, i.e., away from the foot. As shown, in particular, in FIGS. 1A and 1B, a majority of the outward facing surface is not connected to the heel portion 3 of the upper 1 such that a void 4 is formed between the outward facing surface of the heel element 2 and the heel portion 3 of the upper 1. Therefore, the heel element 2 is movable with respect to the upper 1, in particular, in a longitudinal direction of the shoe, to accommodate for different sizes, widths, lengths and shapes of feet.

The heel element 2 defines a rim portion 5 which generally defines a border or margin of the heel element 2. At least a section of the rim portion 5 connects the heel element 2 to the remaining part of the shoe. In the exemplary embodiment of FIGS. 1A-D the heel element 2 is sewn to both a strobel board 6 and a rim portion of the upper 1. This seam is marked in FIG. 1C by the hatched area 7. In FIG. 1D, the seam 8 connecting the heel element 2 to the strobel board 6 and the upper 1 is visible from the inside of the upper 1. In other embodiments, the heel element 2 would be sewn or otherwise connected (e.g., glued or welded) to other portions of the shoe such as a midsole, an outsole, an insole etc.

Both the upper 1 and the heel element 2 in the exemplary embodiments of FIGS. 1A-D are made from a textile material. In some embodiments, the textile material may comprise a mesh material, a weft or warp knitted fabric, a woven material, a non-woven or combinations thereof.

In the exemplary embodiment of FIGS. 1A-D, the heel element 2 comprises an upper portion 9*a* and a lower portion 9*b* as in particular shown in FIG. 1D. In some embodiments, the upper portion 9*a* comprises a padding or cushioning insert made from a foam material. In such embodiments, the key benefit of this is to create a snug fit around the foot. The inner side, i.e., the side facing the foot, of the upper portion 9*a* is made from a soft material. In some embodiments, the upper portion 9*a* may comprise a mesh material. In some embodiments, the lower portion 9*b* is made from a material having a higher stretchability than the upper portion 9*a*. Both portions 9*a* and 9*b* may be connected by a seam.

Figure 1B:
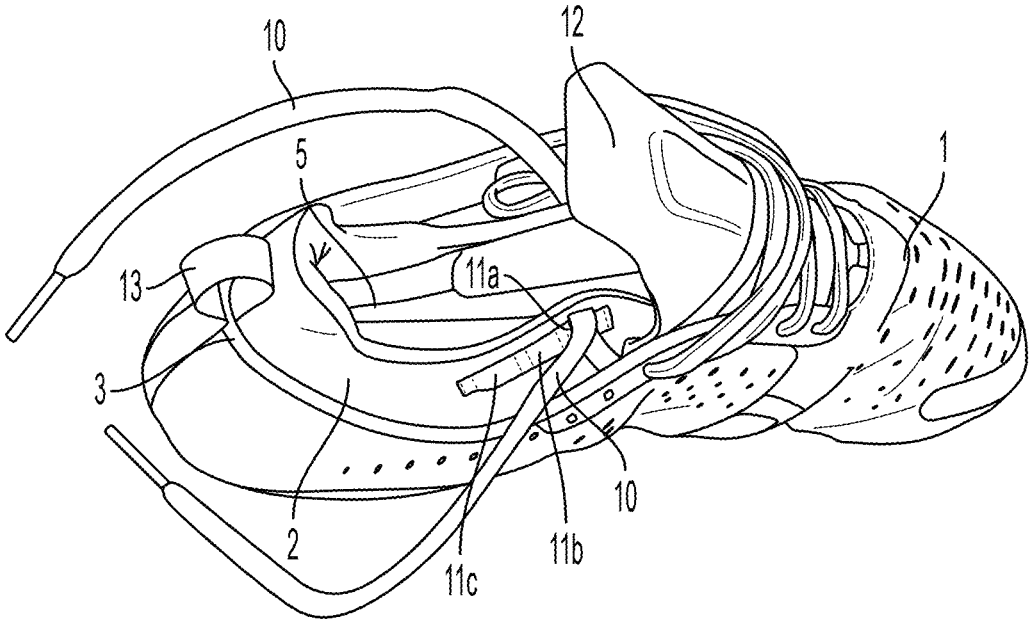
Figure 1C:
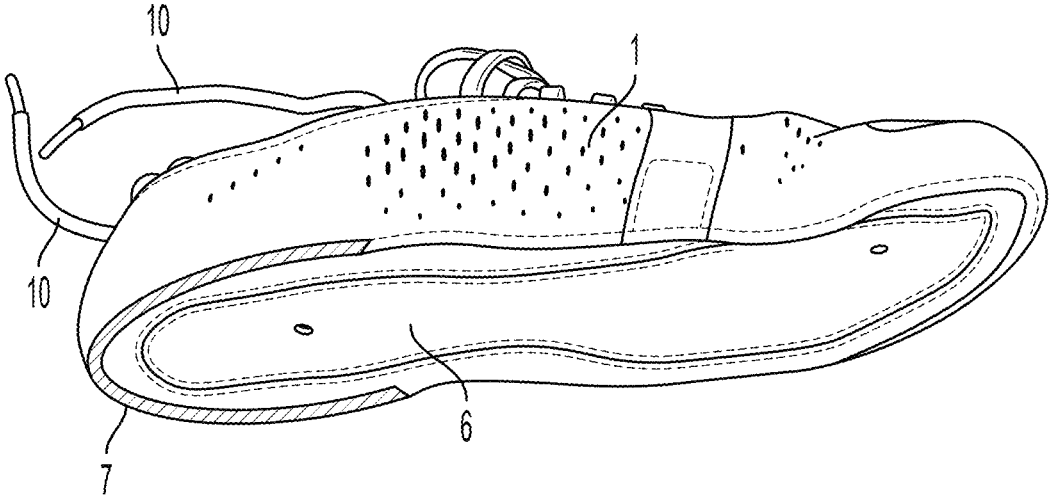
Figure 1D:
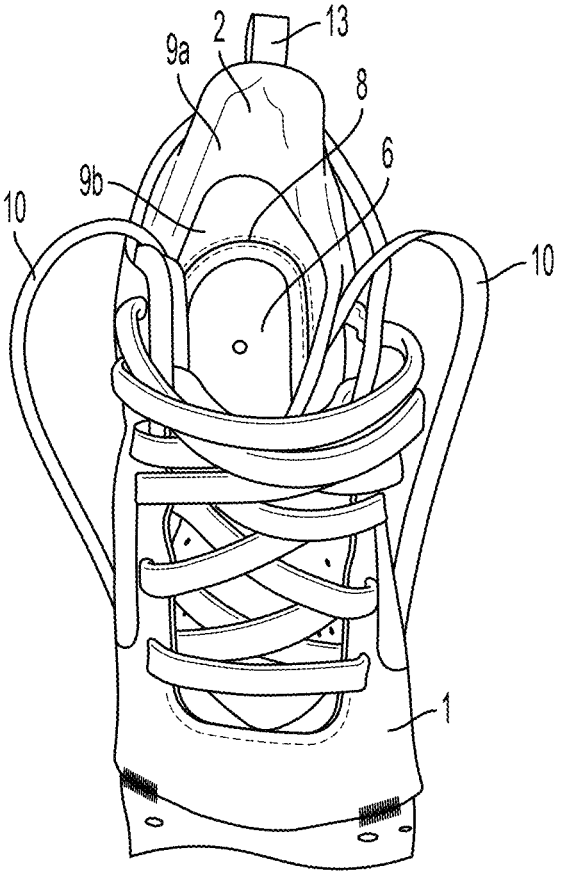

As, in particular, shown in FIG. 1B, the heel element 2 is coupled to a lace 10 of the shoe. This is accomplished by a lace eyelet (for example, loop 11*a*) through which the lace 10 is threaded. A similar lace eyelet (for example, a loop) is located on the opposite side of the heel element 2 receiving the lace 10. Also, the heel element 2 comprises additional lace eyelets (for example, loops 11*b* and 11*c*) which allow securing the heel element 2 relative to the upper 1 in different positions to compensate for a different size, length, shape, etc. of a foot. Thus, when the lace 10 is threaded through a first lace eyelet (for example, loop 11*a*), the heel element 2 is in a position closest to the heel portion 3 of the upper 1. In contrast, when the lace 10 is threaded through a second lace eyelet (for example, the loop 11*c*), the heel element would be in a position closer to the tongue 12 of the shoe. When the lace 10 is threaded through a third lace eyelet (for example, the loop 11*b*), the heel element 2 would be in a middle position. The opposing side of the heel element 2 comprises three eyelets (for example, loops similar to the loops 11*a*, 11*b* and 11*c*). In some embodiments, the number of lace eyelets may vary and instead of loops, the heel element 2 may comprise lace eyelets in the form of lugs and/or punch holes. In some embodiments, the lace eyelets may be in the form of a hook, strap or similar means to fasten the heel element to the upper at different positions. The loops 11*a*, 11*b* and 11*c* in the exemplary embodiment of FIGS. 1A-D are realized by a strap sewn to the outer side of the heel element 2, wherein the seams are arranged to form three voids forming the loops 11*a*, 11*b* and 11*c*. In some embodiments, the lace eyelets may be located on flap-like extensions, for example the extensions 16*a* and 16*b* described below in connection with FIG. 3.

In some embodiments, as shown for example in FIGS. 1A-D, the shoe may also comprise a flap 13 connecting the heel portion 3 of the upper 1 and the heel element 2. In such embodiments, a wearer of the shoe can grab the flap 13 when putting on the shoe to generally pull the shoe towards the foot but also to pull the heel element 2 towards the heel portion 3 of the shoe upper 1 to facilitate inserting the foot. The flap 13 in the exemplary embodiment is realized by a strap which is sewn to the outer side of the upper 1 and to the outward facing surface of the heel element 2.

Figure 2A:
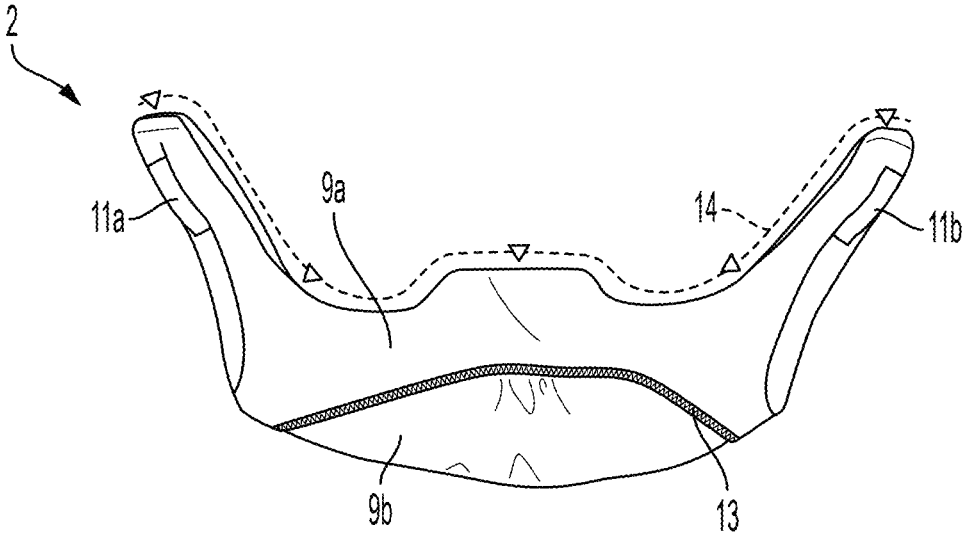
FIGS. 2A-C show an upper and a heel element arranged in the upper for a shoe according to some embodiments.
Figure 2B:
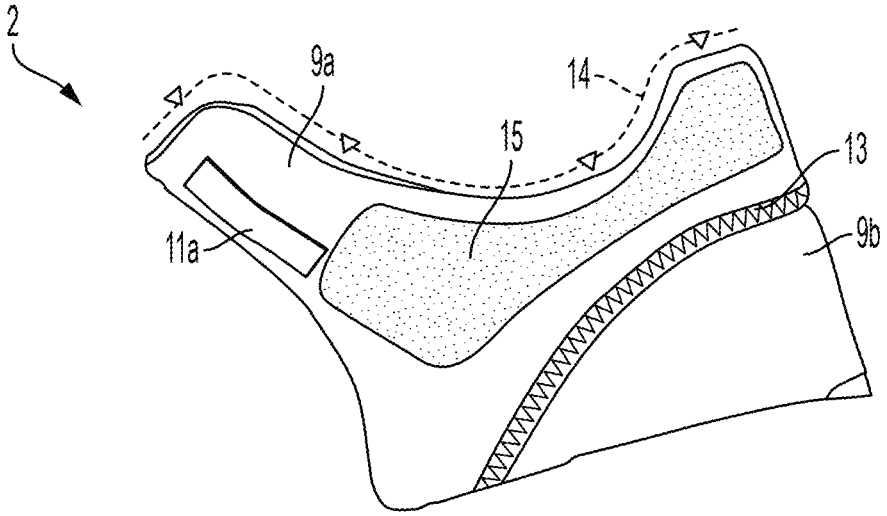
Figure 2C:
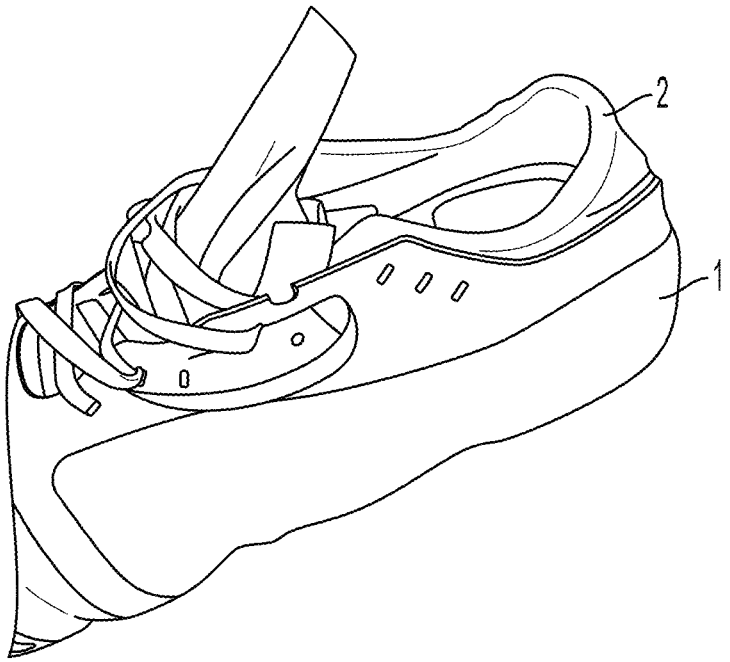

FIGS. 2A and 2B show a heel element 2 according to some embodiments. FIG. 2C shows the heel element of FIGS. 2A and 2B arranged in a shoe upper 1 for a shoe according to some embodiments. Also in this example, the heel element 2 comprises an upper portion 9*a* and a lower portion 9*b*. The upper portion 9*a* comprises a foam insert whose location is indicated by the area denoted with the reference numeral 15. The foam insert has a thickness of, for example 5 mm but may have a different thickness in other embodiments. The upper portion 9*a* comprises a front and back side which are joined by a stitch and turn seam which is indicated by line 14. The lower portion 9*b* is a stretch insert having a higher stretchability than the upper portion 9*a*. Also, the heel element of FIGS. 2A-C comprises lace loops 11*a* and 11*b* for receiving laces of the shoe.

Figure 3:
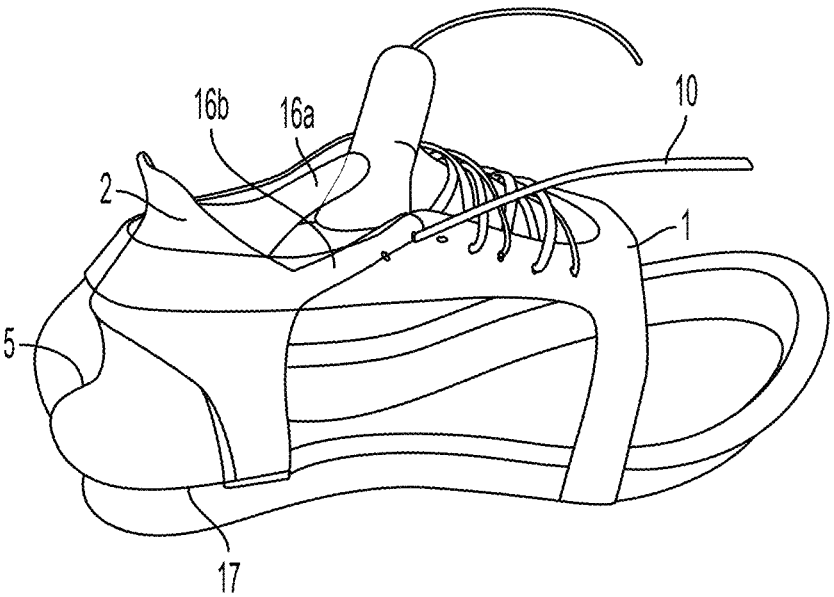
FIG. 3 illustrates the position of a heel element in a shoe upper of a shoe according to some embodiments.

FIG. 3 illustrates the position of a heel element 2 in a shoe upper 1 of a shoe according to some embodiments. The rim or edge of the heel element is highlighted in FIG. 3 and marked by reference numeral 5. Thus, the heel element 2 would cover at least a portion of the heel of a wearer. The heel element 2 extends from a bottom portion of the shoe to the Achilles tendon and forms two flap-like extensions 16*a* and 16*b* extending to the instep portion. Lace eyelets (for example, the loops 11*a*, 11*b* and 11*c* explained with respect to FIGS. 1A-D) would be located on those extensions 16*a* and 16*b*. The heel element 2 shown in FIG. 3 is connected to the shoe upper 1 at the bottom portion 17 of its rim portion 5.

Figure 4A:
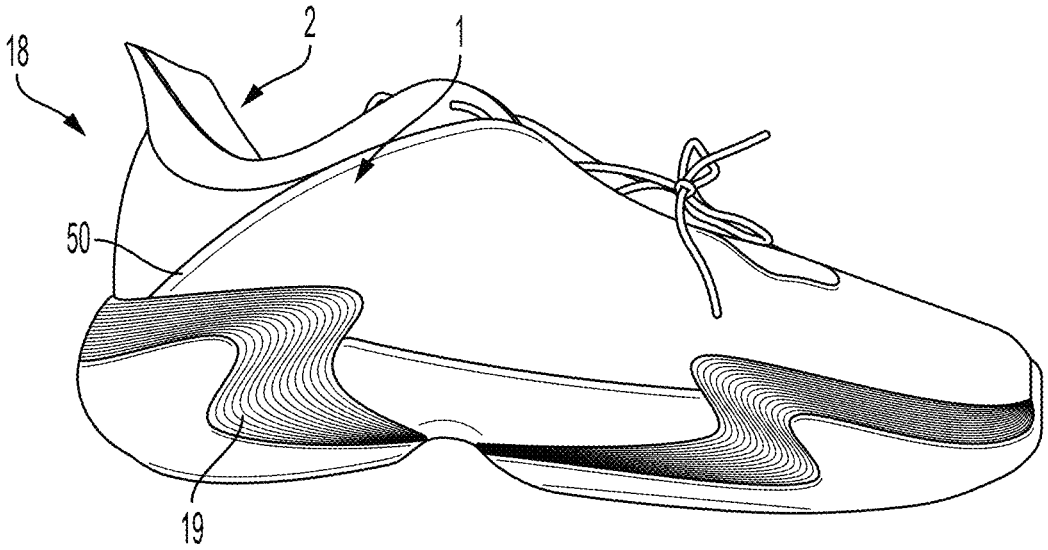
FIGS. 4A-C show a shoe according to some embodiments.
Figure 4B:
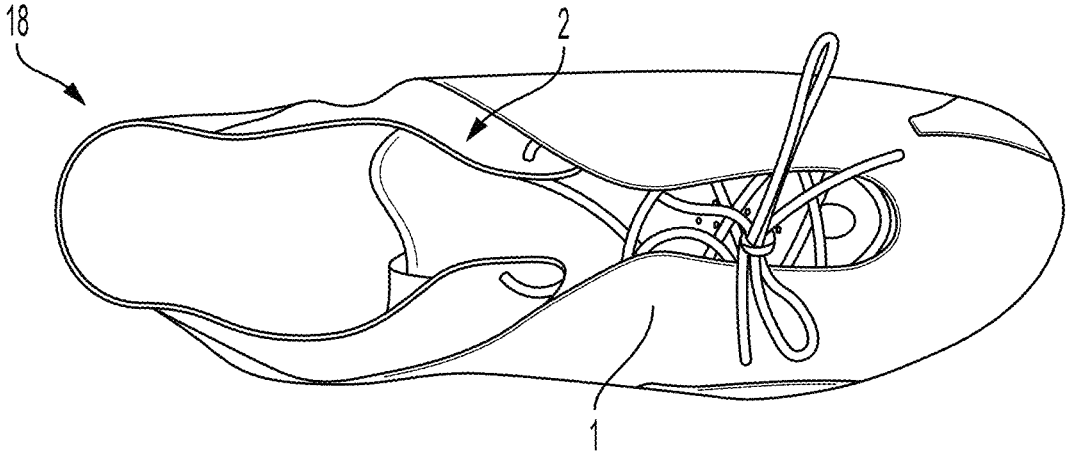
Figure 4C:
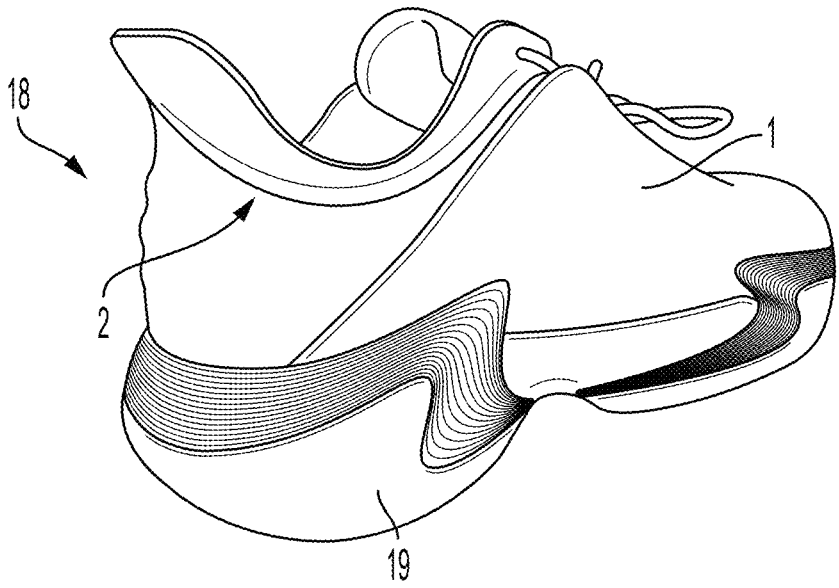

FIGS. 4A, 4B and 4C show a shoe 18 according to some embodiments. FIG. 4A shows a side view, FIG. 4B a top view and FIG. 4C a lateral/rear view. The shoe 18 comprises an upper 1, a heel element 2 and a sole structure 19. In contrast to the previous embodiments of FIGS. 1-3, the upper 1 does not comprise a heel portion but instead is open at the heel. In such embodiments, the upper 1 comprises a rear-most perimeter rim 50 defining a hollow, rear-facing opening on shoe 18. Rear-most perimeter rim 50 may comprise a lateral side defining a lateral side of the rear-facing opening and a medial side defining a medial side of the rear-facing opening. The heel element 2 is not fixedly connected to the upper 1 and movable with respect to the upper 1. The heel element 2 is connected to the rest of the shoe at the strobel board. In the embodiment shown in FIGS. 4A-C, heel element 2 fits within the rear-most perimeter rim 50 of upper 1 to enclose the hollow, rear-facing opening defined by rim 50.

Figure 5A:
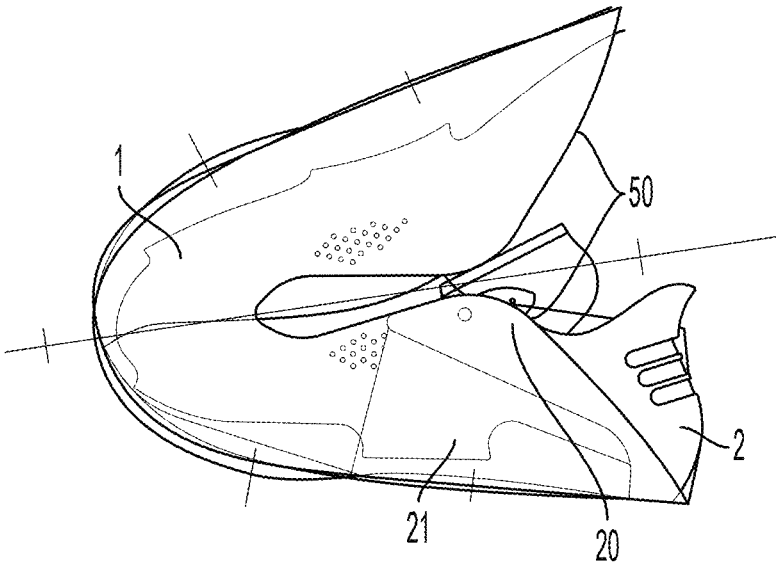
FIG. 5A is a schematic of the upper and heel element of the shoe of FIGS. 4A-C.

FIG. 5A is a schematic of the upper 1 and heel element 2 of the embodiments of FIGS. 4A-C illustrating the positions of both elements relative to each other. It shows the upper 1 in a flat configuration, i.e., before being integrated into a shoe. The heel element 2 is not connected to the upper 1 such that the heel element 2 is movable with respect to the upper 1. The upper 1 does not comprise a heel portion. Rather, in the final shoe, the heel element 2 will form the rearmost portion of the shoe surrounding the foot. As illustrated in FIG. 5A, the heel element 2 and the upper 1 overlap partially in the area denoted by reference numeral 20. Such an area is present on the final shoe 18 on both sides, i.e., the lateral and medial side. FIG. 5A also shows an optional support shroud 21 (or stabilizing sheath/gusset) which is attached to the bottom edge of the heel element 2, but not to the upper. Rather, the support shroud 21 may be connected to the remainder of the shoe in the same manner as heel element 2 is connected to the remainder of the shoe. For example, the support shroud 21 may be connected to the remainder of the shoe at the strobel board, just like the heel element 2. The support shroud 21 helps to keep the heel element 2 registered in correct position. The shroud 21 is optional and other embodiments do not comprise a support shroud.

Figure 5B:
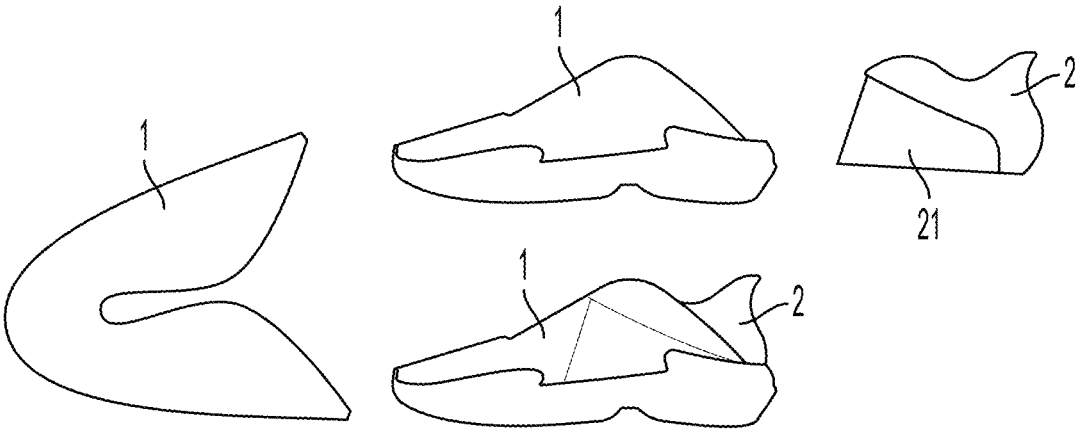
FIG. 5B illustrates outlines of the upper, heel element and support shroud of FIG. 5A.

FIG. 5B illustrates the outlines of the upper 1, heel element 2 and support shroud 21 of FIG. 5A. It illustrates that the upper 1 does not have a heel portion and is open at the heel.

Figure 6:
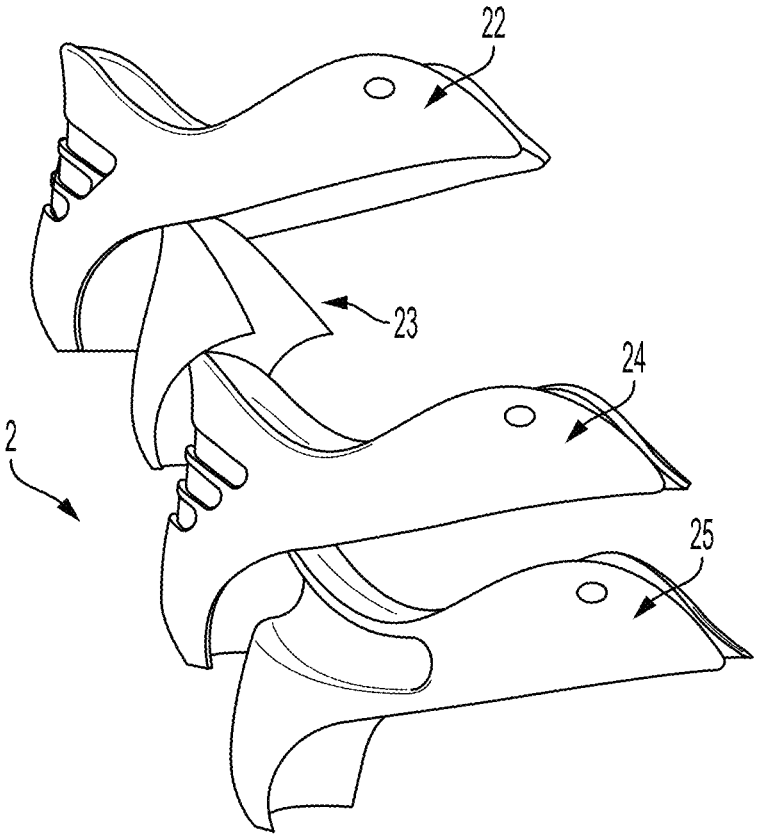
FIG. 6 illustrates the composition of a heel element according to some embodiments.

FIG. 6 illustrates the composition of the heel element 2 of the embodiment of FIGS. 4A-C according to some embodiments. The outer layer of the heel element 2 is a textile material 22. An integrated heel counter 23 reinforces the heel element 2. The integrated heel counter 23 may reinforce the heel portion of the shoe because the upper 1 of FIGS. 4A-C does not have a heel portion. Thus, stability, support and protection is provided to the heel only by the heel element 2. In some embodiments, the heel counter 23 may be molded piece. For comfort and padding, the heel element 2 comprises a foam package 24, which may be molded piece as well. Finally, the inner side of the heel element 2 facing the foot is finished by a liner material 25. In some embodiments, the heel element 2 described in connection with FIGS. 1A-3 or FIGS. 7A-9C may comprise the composition shown in FIG. 6.

Figure 7A:
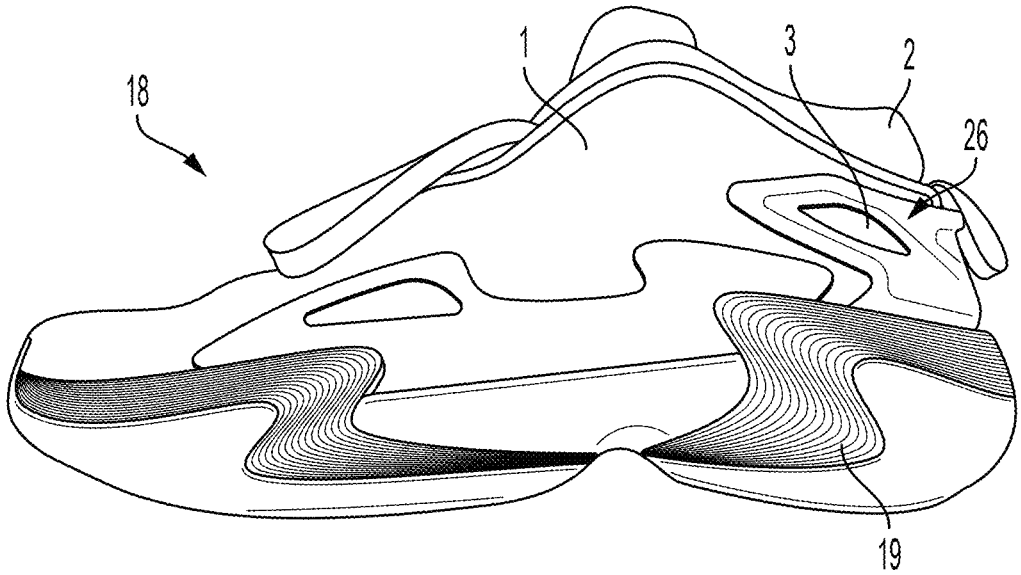
FIGS. 7A-C show a shoe according to some embodiments.
Figure 7B:
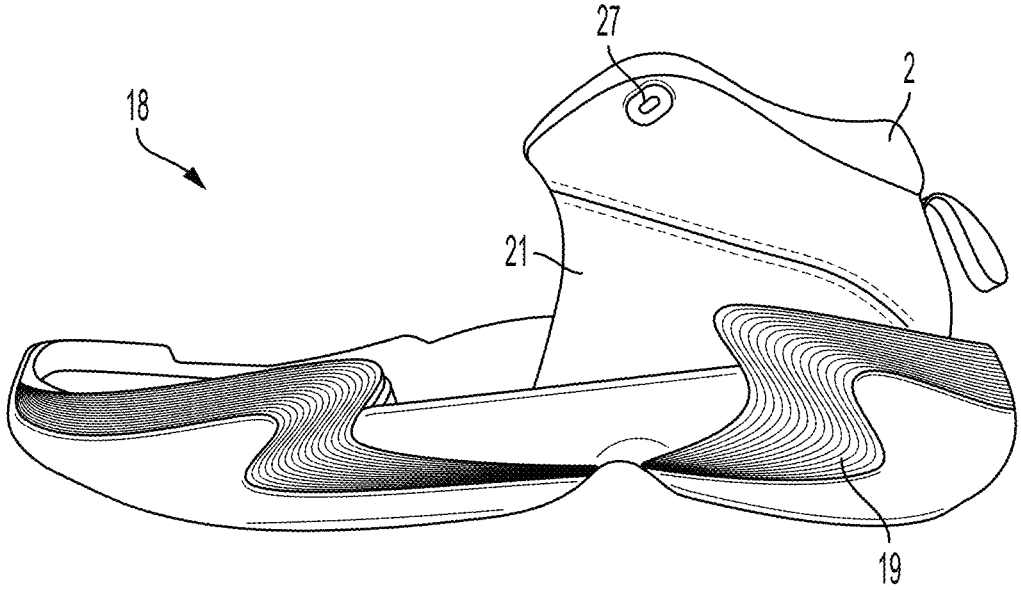
Figure 7C:
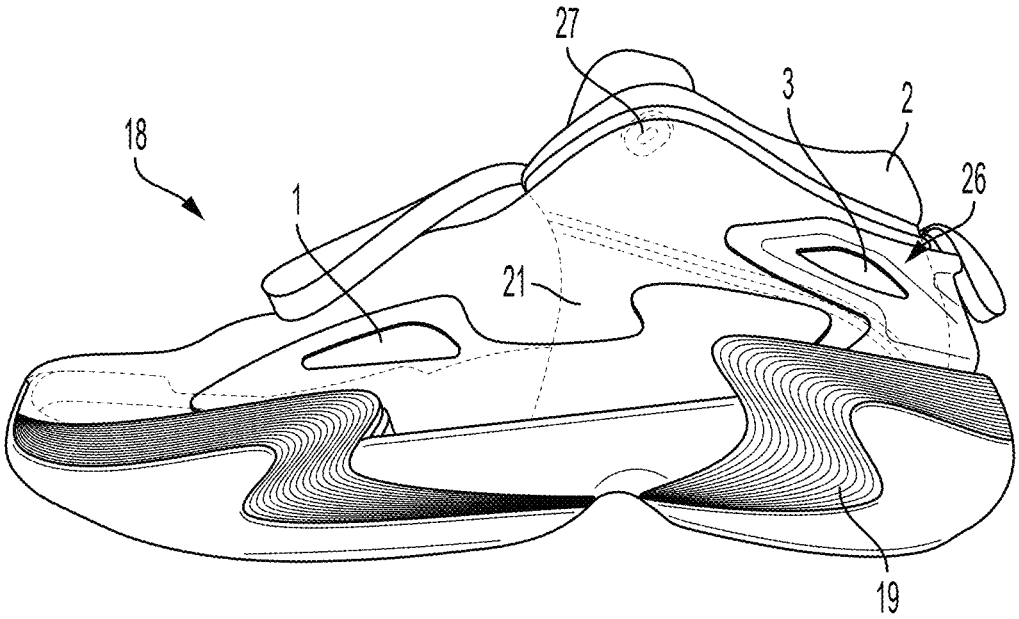

FIGS. 7A-C show a shoe according to some embodiments comprising an upper 1, heel element 2 and sole structure 19. FIG. 7A shows the entire shoe. FIG. 7B shows the shoe with the upper 1 removed, i.e., only the heel element 2 and sole structure 19. FIG. 7C is an "x-ray view" showing the position of the heel element 2 inside the upper 1. The upper 1 in the embodiment of FIGS. 7A-C comprises a heel portion 3. An external heel counter 26 is arranged on the heel portion 3. A support shroud 21 is joined to lower rim of the heel element 2 and is connected to the rest of the shoe 18 at the strobel board. Just like in the other embodiments described herein, the heel element 2 is not connected to the upper 1 such that the heel element 2 is movable with respect to the upper 1. The heel element 2 comprises an eyelet 27 through which a lace of the shoe can be threaded. It is understood that there is an eyelet 27 on either side (lateral and medial) of the heel element 2. It will be described with respect to FIGS. 9A-C, how the heel element 2 is activated to lock down the foot via the lace of the shoe 18.

Figure 8A:
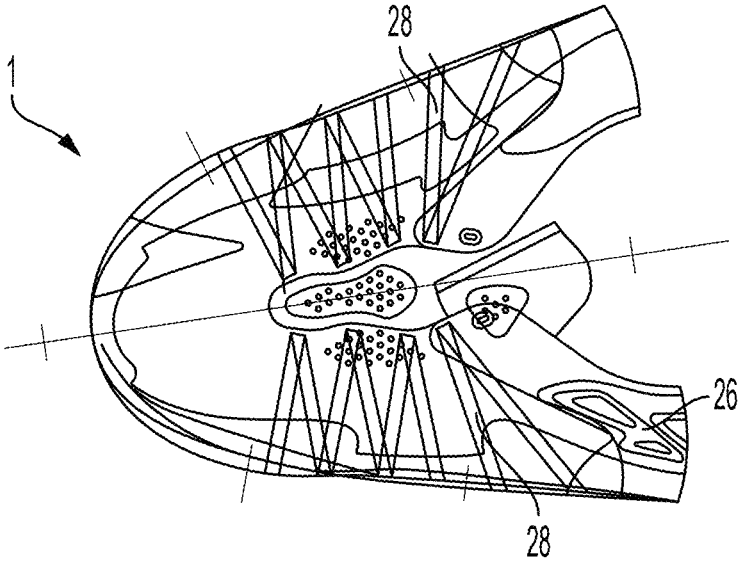
FIG. 8A shows a schematic of the upper of the shoe of FIGS. 7A-C.

FIG. 8A shows a schematic of the upper 1 of the embodiment of FIGS. 7A-C. Besides the heel counter 26, FIG. 8A also shows that the upper 1 comprises webbings, one of which is denoted by reference numeral 28 and which serve as anchor points (lace eyelets) for the lace of the shoe. The webbings in the exemplary embodiment of FIG. 8A extend to the edge of the upper 1 and will be connected to the sole structure of the shoe. The webbings 28 are configured to receive the lace 10 of the shoe and function like loops through which the lace 10 is threaded. In other embodiments, for example like in the embodiment shown in FIGS. 9A-C, the webbings do not extend to the sole structure of the shoe. Also, instead of webbings, loops, lugs, or punch holes could be used.

Figure 8B:
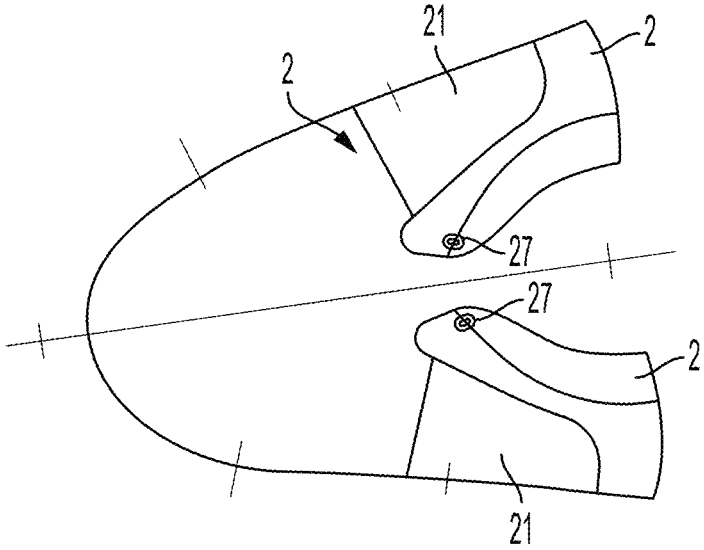
FIG. 8B shows a schematic of the heel element of the shoe of FIGS. 7A-C.

FIG. 8B shows a schematic of the heel element 2 of the embodiment of FIGS. 7A-C. The contour of the upper (cf. FIG. 8A) is shown as well to illustrate the relative arrangement of upper 1 and heel element 2. As previously described, the upper 1 and the heel element 2 are movable with respect to each other in the final shoe, which means that they are not joined in the plane in which they coextend.

Figure 9A:
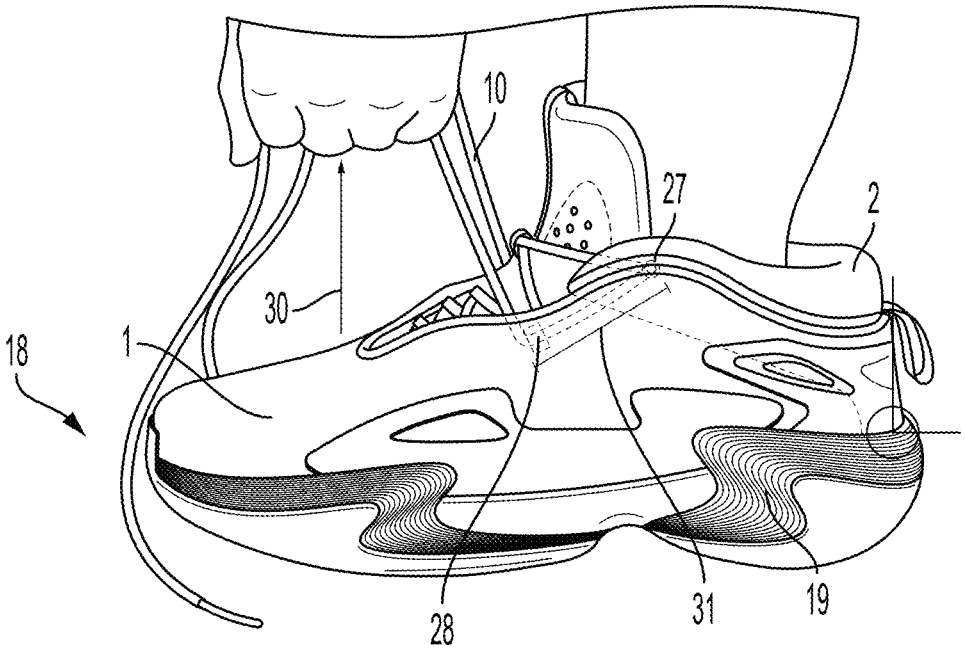
FIG. 9A-C show operation of the heel element according to some embodiments.
Figure 9B:
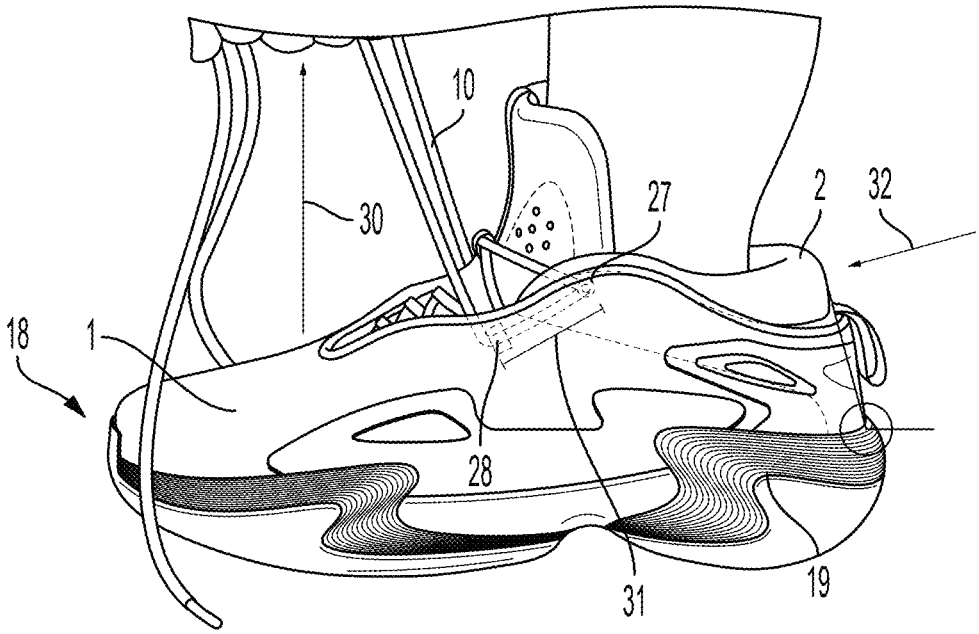
Figure 9C:
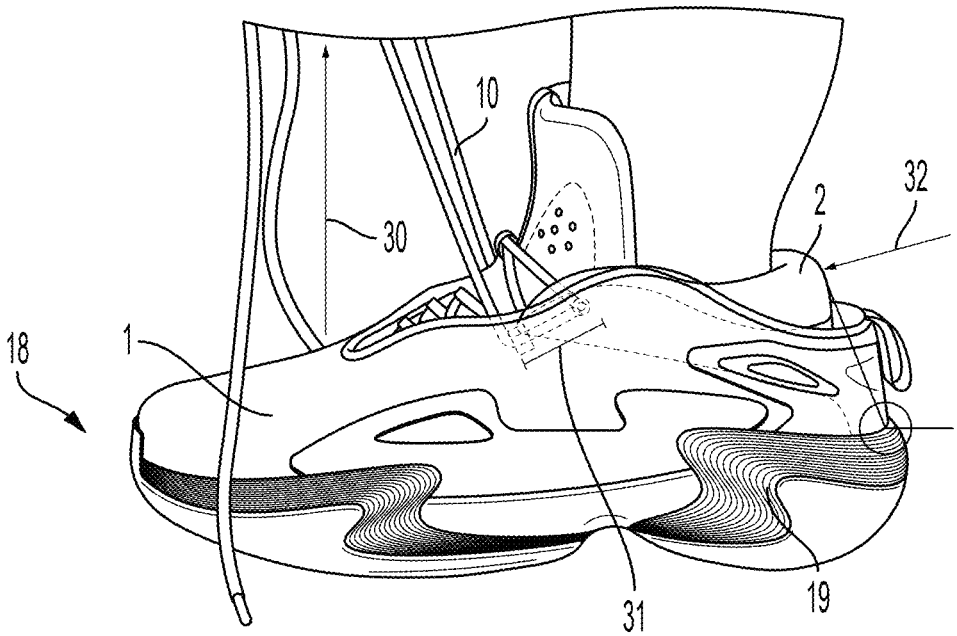

FIGS. 9A-C show how the heel element 2 is activated by pulling the lace 10 of the shoe 18 according to some embodiments. Any heel element 2 embodiment described herein can be activated by a lace 10 as described in connection with FIGS. 9A-C.

FIG. 9A shows the start of pull up of the lace 10. When the wearer pulls up vertically (as indicated by the arrow 30) on the lace 10, which is the natural and intuitive way to tie the shoes), the tension from the lace 10 will activate the articulating heel element 2 to start moving forward in a horizontal movement towards the wearer's heel. This articulating movement of the heel element 2 may comprise a sliding movement of the heel element 2 in the forward direction, a pivoting movement of the heel element 2 in the forward direction, or a combination of both a sliding and pivoting movement. In any event, the articulating movement can reduce a distance 31 between a lace eyelet 27 on the heel element 2 and a lace eyelet (for example, webbing 28) of the upper 1. As shown in FIGS. 9A and 9B, there is an initial distance 31 between the lace eyelet 27 of heel element 2 and the lace eyelet (webbing 28) of upper 1 that decreases during the process of pulling the lace 10.

FIG. 9B shows a state approximately in the middle of the heel element activation. The increased vertical force 30 during the pull up of the lace 10 adds tension in the system, starting at the eyelet 27 of the articulating heel element 2. As the tension increases, the eyelet 27 is brought closer to the lace eyelet (webbing 28) of the upper 1 through a system of pulleys causing the heel element 2 to pivot forward as also indicated by the arrow 32 and the decreased distance 31.

FIG. 9C shows the full heel lockdown. The system is fully locked when the articulating heel element 2 is fully engaged with the wearer's heel geometry. As shown in FIG. 9C, the wearer has pulled the lace 10 up, the distance 31 between the lace eyelet of heel element 2 and the lace eyelet of the upper 1 has further decreased and the heel element 2 has moved forward to fit snuggly with the heel as indicated by the arrow 32.

Thus, the vertical pulling force exerted on the lace 10 is transformed into a horizontal force acting on the heel element 2 and pulling it towards the heel of the wearer to look down the foot in the shoe. This lacing mechanism according to embodiments of the present disclosure is engineered to form a lever. When the athlete intuitively laces their shoes and pulls vertically on the laces, the lever mechanism in the lacing architecture will bring the heel element forward, directly against the athlete's unique heel morphology. Thus, a self-adjusting system is provided.

Figure 10A:
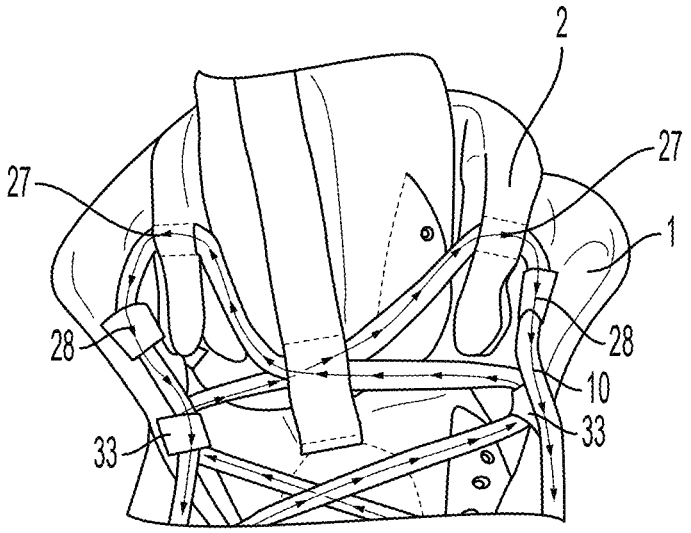
FIGS. 10A-B show a lacing system according to some embodiments.

FIG. 10A shows details of the lacing system according to some embodiments and how it interacts with the heel element 2. The shoe comprises a standard lacing until the second to last eyelet 33 of the upper which in this example is realized as a webbing. Instead of webbings, loops, lugs or punch holes could be used. It is understood that there is a second to last eyelet 33 on either side of the upper 1 (lateral and medial). From the second to last eyelet 33, the lace passes to an opposing eyelet 27 of the heel element 2. In some embodiments, the lace may pass through eyelet 27 from an inward facing side to an outward facing side of heel element 2. Again, there is an eyelet 27 on either side of the heel element 2 and the lateral eyelet 27 receives the lace 10 from the medial eyelet 33 of the upper, whereas the medial eyelet 27 receives the lace 10 from the lateral eyelet 33 of the upper. From the eyelet 27 the lace 10 passes to the final eyelet 28 of the upper 1 which in this example is again provided as a webbing. A webbing 28 is arranged on either side of the upper (lateral and medial) as a final lacing point.

This final lacing point is below the eyelet 27 of the heel element 2. Thus, when the lace 10 is pulled, the heel element 2 is pulled towards the upper 1 by means of the lace 10.

Figure 10B:
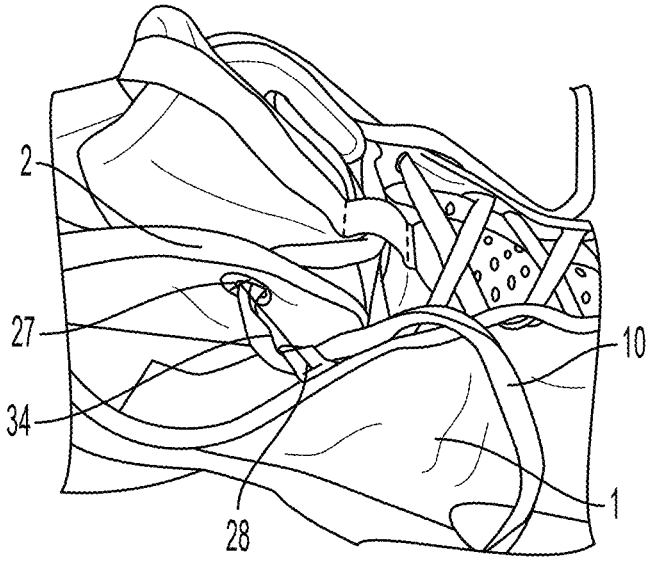

FIG. 10B shows details of the lacing system from another perspective. It also shows the distance 34 which the heel element 2 is able to move forward when pulling the lace 10 as previously described. This distance 34 is directly tied to the distance between the eyelet 27 of the heel element 2 and the webbing 28 on the upper 1. The distance between the eyelet 27 and the webbing 28 is the distance that the heel element can articulate forward when the system is engaged during lacing.

Figure 11A:
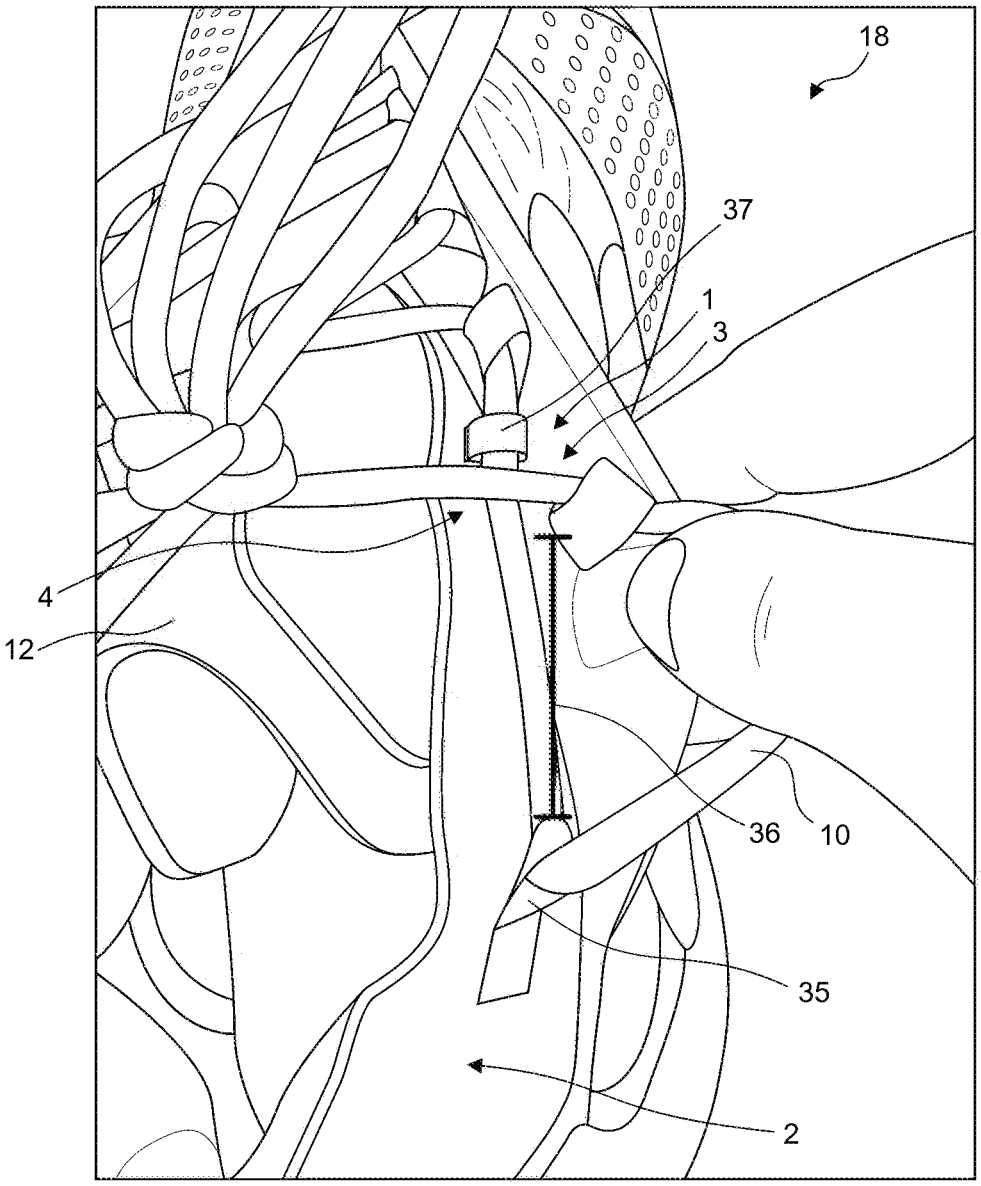
FIGS. 11A-B show a lacing system according to some embodiments.
Figure 11B:
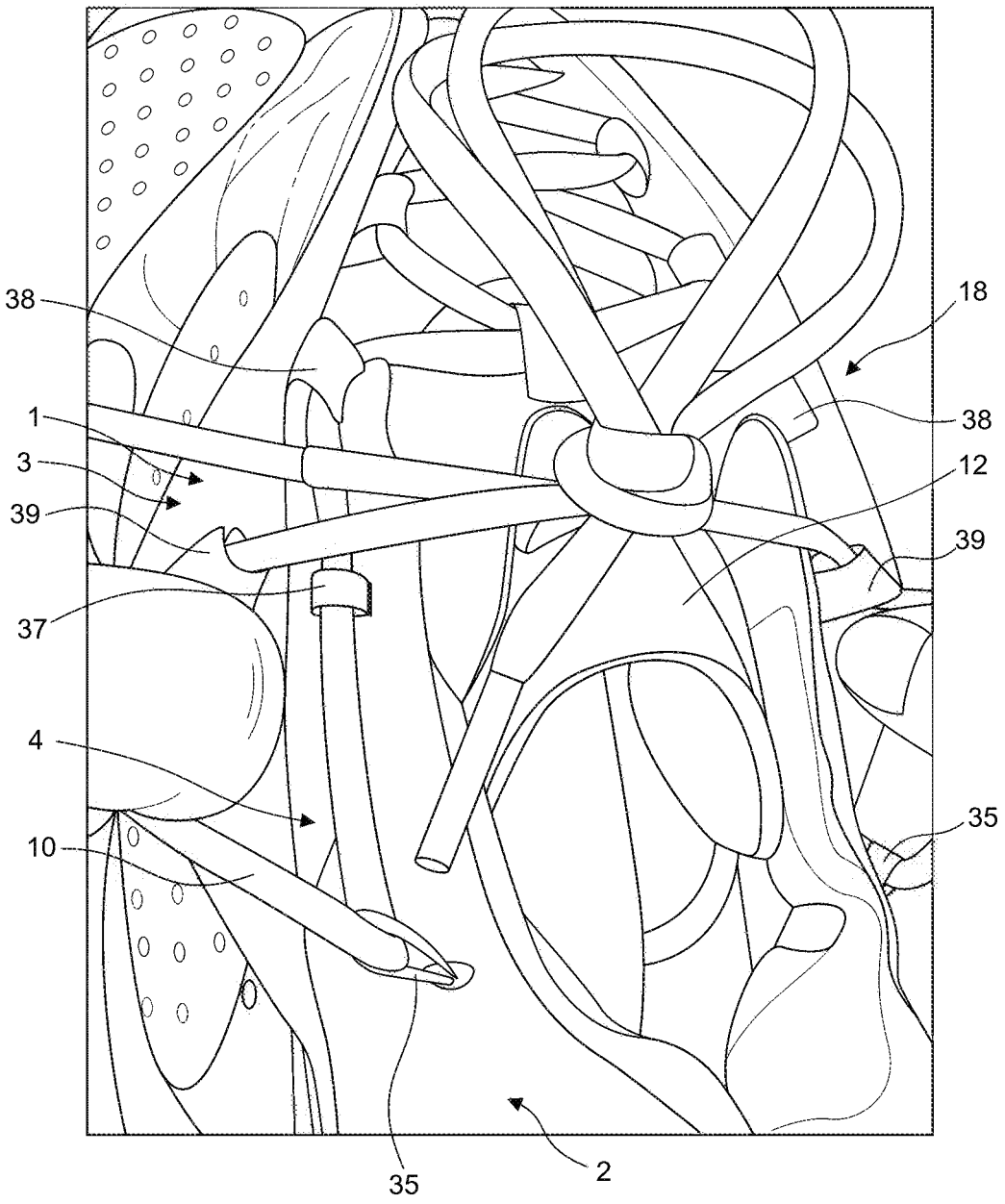

FIGS. 11A-B show how heel element 2 is activated by pulling lace 10 of shoe 18 according to some embodiments. Any heel element 2 embodiment described herein can be activated by lace 10 as described in connection with FIGS. 11A-B.

FIG. 11A shows heel element 2 comprising a fulcrum 35. Fulcrum 35 is configured to provide a lever for moving heel element 2 relative to upper when the wearer pulls lace 10. Specifically, lace 10 passes through and forms a bend about fulcrum 35 such that pulling lace 10 activates heel element 2 via a lever imparted about fulcrum 35, causing heel element 2 to begin moving towards the wearer's heel. This movement of heel element 2 towards the wearer's heel may comprise a sliding movement of heel element 2 in the forward direction, a pivoting movement of heel element 2 in the forward direction, or a combination thereof. In any event, the movement of heel element 2 may reduce a distance 36 between fulcrum 35 and a lace eyelet (for example, webbing 28) of upper 1.

Distance 36 between fulcrum 35 and lace eyelet (for example, webbing 28) of upper 1 is the distance that heel element 2 can articulate forward when lace 10 is pulled. In some embodiments, fulcrum 35 is positioned on a rear-half portion of heel element 2, increasing distance 36 between fulcrum 35 and lace eyelet (for example, webbing 28) of upper 1, thereby increasing the distance that heel element 2 can articulate forward when lace 10 is pulled. An increased articulation distance of heel element 2 is beneficial, as it provides greater adjustability of shoe 18 and, consequentially, a better fit for its wearer. In some embodiments, distance 36 ranges from 30 mm to 50 mm when heel element 2 is in an unactivated state (e.g., when shoe 18 is not in use). In some embodiments, fulcrum 35 is positioned rearward of a rearmost portion of tongue 12 of the shoe 18.

As shown in FIG. 11A, heel element 2 may further comprise a lace guide 37. Lace guide 37 is configured to position lace 10 along a surface of heel element 2 as lace 10 passes to fulcrum 35. In some embodiments, lace 10 may pass through lace guide 37 in a direction that is parallel to the lever provided by fulcrum 35 when the wearer pulls lace 10. This orientation of lace 10 provided by lace guide 37 may allow for the wearer to adjust heel element 2 easily.

In some embodiments, lace guide 37 may be positioned on the outward facing surface of heel element 2 adjacent to an inward facing surface of heel portion 3 of upper 1. In some embodiments, the inward facing surface of heel portion 3 where lace guide 37 is positioned may overlap the outward facing surface of heel element 2 so that lace guide 37 is tucked away from the top of the wearer's foot when wearing shoe 18. In some embodiments, at least a portion of lace guide 37 is tucked within void 4.

In some embodiments, fulcrum 35 may be positioned on the outward facing surface of heel element 2 adjacent to an inward facing surface of heel portion 3 of upper 1. In some embodiments, the inward facing surface of heel portion 3 wherein fulcrum 35 is positioned may overlap the outward facing surface of heel element 2 so that fulcrum 35 is tucked away from the top of the wearer's foot when wearing shoe 18. In some embodiments, at least a portion of fulcrum 35 is tucked within void 4.

In embodiments were lace guide 37 and/or fulcrum 35 is tucked with the void 4, at least a portion of the lace 10 is tucked into the void 4. In such embodiments, the inward facing surface of heel portion 3 may overlap the outward facing surface of heel element 2 so that at least a portion of the lace 10 is tucked away from the top of the wearer's foot when wearing shoe 18.

In some embodiments, heel portion 3 may be omitted such that lace guide 37 and/or fulcrum 35 guide lace 10 away from the top of the wearer's foot in absence of an adjacent inward facing surface of heel portion 3.

There may be a fulcrum 35 and/or lace guide 37 on either side (lateral and medial) of heel element 2. In such embodiments, heel element 2 may comprise a second fulcrum 35 on a side opposite to first fulcrum 35. Similarly, in such embodiments, heel element 2 may comprise a second lace guide 37 on a side opposite to first lace guide 37. Fulcrum 35 and/or lace guide 37 may be a lace eyelet, loop, webbing, lug, punch hole, or any other structure suitable for securing lace 10 and/or providing a lever for moving heel element 2 relative to upper 1 when lace 10 is pulled.

FIG. 11B shows details of the lacing system according to some embodiments and how it interacts with heel element 2. Shoe 18 comprises standard lacing until a second to last eyelet 38 which, as illustrated in FIG. 11B, may be a webbing. Instead of a webbing, a loop, a lug, a punch hole, or any other structure suitable for securing lace 10 could be used. In some embodiments, there is a second to last eyelet 38 on either side (lateral and medial) of upper 1. In such embodiments, the upper comprises an additional second to last eyelet 38 on a side opposite to the second to last eyelet 38. From the second to last eyelet 38, lace 10 passes to lace guide 37. From lace guide 37, lace 10 passes to fulcrum 35. Finally, from fulcrum 10, lace 10 passes to a final eyelet 39 on upper 1 which, as illustrated in FIG. 11B, may be a webbing. Again, instead of a webbing, a loop, a lug, a punch hole, or any other structure suitable for securing lace 10 could be used. In some embodiments, there is a final eyelet 39 on either side (lateral and medial) of upper 1. In such embodiments, the upper comprises a second final eyelet 39 on a side opposite to first final eyelet 39. In some embodiments, the lace guide 37 may be omitted such that lace 10 passes directly from second to last eyelet 38 to fulcrum 35.

Figure 12A:
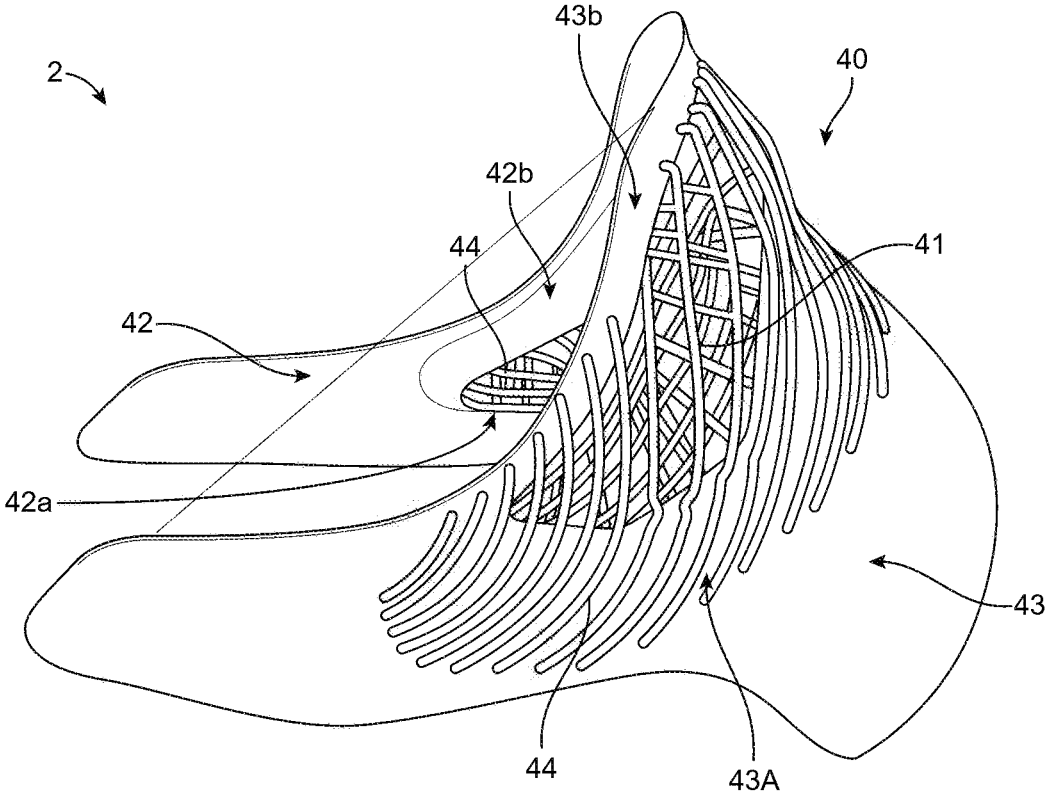
FIGS. 12A-B show a heel element according to some embodiments.

As shown for example in FIG. 12A, in some embodiments, heel element 2 may be manufactured via an additive manufacturing technique. Exemplary additive manufacturing techniques include for example, selective laser sintering, selective laser melting, selective heat sintering, stereo lithography, fused deposition modeling, or 3-D printing in general. Various additive manufacturing techniques related to articles of footwear are described for example in US 2009/0126225, WO 2010/126708, US 2014/0300676, US 2014/0300675, US 2014/0299009, US 2014/0026773, US 2014/0029030, WO 2014/008331, WO 2014/015037, US 2014/0020191, EP 2564719, EP 2424398, and US 2012/0117825. In some embodiments, the additive manufacturing process can include a continuous liquid interface production process.

In some embodiments, heel element 2 may comprise an opening 41. Opening 41 may reduce the amount of material needed to form heel element 2, reducing the weight of heel element 2 and, therefore, reducing the overall weight of shoe 18-which may provide a performance benefit for the wearer. Additionally, opening 41 may mitigate contact between an inward facing surface 42 of heel element 2 and the wearer's heel, preventing chafing of the wearer's heel. Opening 41 may also provide breathability to shoe 18, which may be desirable when, e.g., the wearer is exercising.

In some embodiments, an outward facing surface 43 of heel element 2 may comprise protruding hatches 44 extending over the outward facing surface 43. In such embodiments, hatches 44 may be configured to provide additional support to heel element 2, thereby providing additional support to the heel of the wearer. In some embodiments, hatches 44 may extend over the outward facing surface 43 at a rear-most portion 40 of heel element 2. In some embodiments, hatches 44 may extend over opening 41, thereby providing additional support to opening 41. In such embodiments, hatches 44 may extend from a first portion of outward facing surface 43*a*, over the opening 40, and to a second portion of the outward facing surface 43*b*.

In some embodiments, the inward facing surface 42 of heel element 2 may comprise hatches 44. In such embodiments, the hatches 44 on the inward facing surface 42 may similarly be configured to provide additional support to heel element 2, thereby providing additional support to the heel of the wearer. In some embodiments, hatches 44 on the inward facing surface 42 may extend over the inward facing surface 42 at the rear-most portion 40 of heel element 2. In some embodiments, hatches 44 on the inward facing surface 42 may extend over opening 41, thereby providing support to opening 41. In such embodiments, hatches 44 may extend from a first portion of inward facing surface 42*a*, over the opening 41, and to a second portion of the inward facing surface 42*b*. In some embodiments, heel element 2 may comprise hatches 44 on both the outward facing surface 43 and the inward facing surface 42.

Figure 12B:
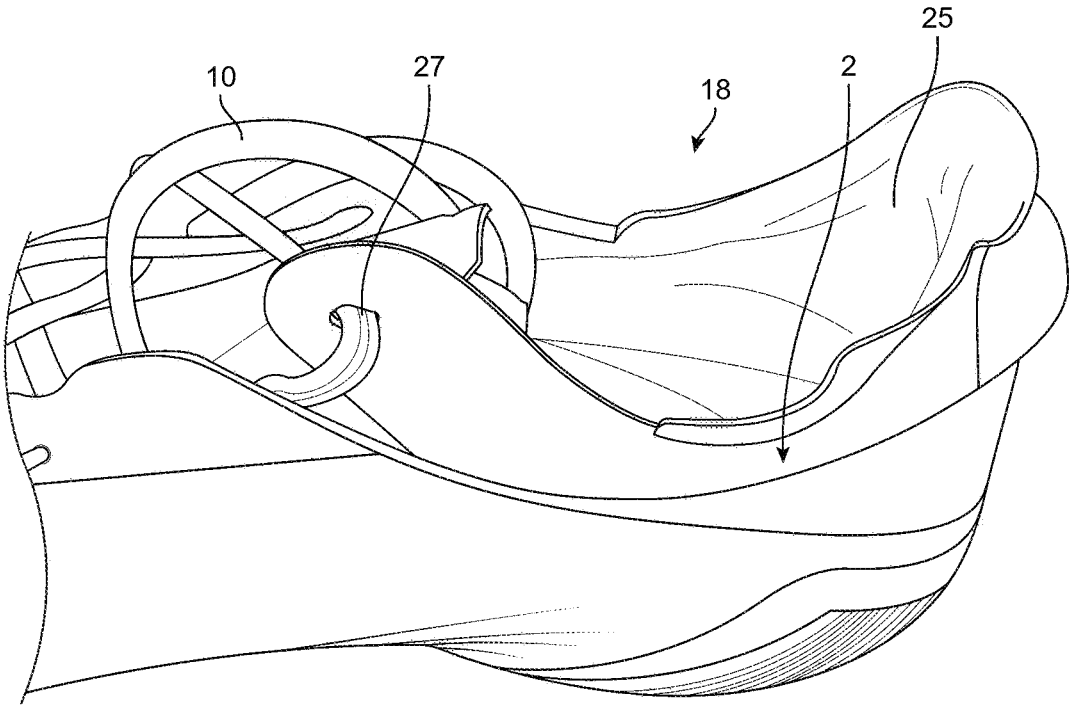

FIG. 12B shows heel element 2 manufactured from an additive manufacturing technique inside shoe 18 according to some embodiments. As shown, heel element 2 may comprise eyelet 27 through which lace 10 may be threaded. There may be an eyelet 27 on either side (lateral and medial) of heel element 2.

As shown, in some embodiments, additive manufactured heel element 2 may comprise liner material 25 coupled to at least a portion of the inward facing surface 42 of the heel element 2.

In some embodiments, additive manufactured heel element 2 may comprise textile material 22 coupled to at least a portion of the outward facing surface 43 of the heel element 2. In such embodiments, textile material 22 may comprise the any of the features of the heel element 2 embodiments discussed above. For example, in some embodiments, textile material 22 may comprise loops 11*a*, 11*b*, and 11*c*. As another example, in some embodiments, textile material 22 may comprise eyelet 27. As yet another example, in some embodiments, textile material 22 may comprise fulcrum 35 and lace guide 37. As an additional example, in some embodiments, textile material 22 may comprise a webbing, a loop, a lug, a punch hole, or any other structure suitable for securing lace 10. In such embodiments, heel element 2 may be configured to move relative to upper 2 by way of an interaction between lace 10 and textile material 22 to which heel element 2 is coupled. In some embodiments, an additive manufactured heel element 2 may be disposed between liner material 25 and textile material 22.

Heel element 2 manufactured from an additive manufacturing technique may be utilized in any of the heel element 2 embodiments discussed above. By way of example, heel element 2 manufactured from an additive manufacturing technique may comprise fulcrum 35 and lace guide 37. In some embodiments, fulcrum and lace guide 37 may be glued to heel element 2. By way of another example, heel element 2 manufactured from an additive manufacturing technique may comprise loops 11*a*, 11*b*, and 11*c*. In some embodiments, a webbing, a loop, a lug, a punch hole, or any other structure suitable for securing lace 10 may be glued to heel element 2.

While various embodiments have been described herein, they have been presented by way of example, and not limitation. It should be apparent that adaptations and modifications are intended to be within the meaning and range of equivalents of the disclosed embodiments, based on the teaching and guidance presented herein. It therefore will be apparent to one skilled in the art that various changes in form and detail can be made to the embodiments disclosed herein without departing from the spirit and scope of the present disclosure. The elements of the embodiments presented herein are not necessarily mutually exclusive, but can be interchanged to meet various situations as would be appreciated by one of skill in the art.

The examples are illustrative, but not limiting, of the present disclosure. Other suitable modifications and adaptations of the variety of conditions and parameters normally encountered in the field, and which would be apparent to those skilled in the art, are within the spirit and scope of the disclosure.

It is to be understood that the phraseology or terminology used herein is for the purpose of description and not of limitation. The breadth and scope of the present disclosure should not be limited by any of the above-described exemplary embodiments, but should be defined in accordance with the following claims and their equivalents.

What is claimed is:

1. A shoe comprising:

an upper; and a heel element arranged at least partially overlapping with at least a part of the upper, wherein:

the heel element is configured to envelop at least a part of a heel of a wearer of the shoe, the heel element is movable with respect to the upper, the heel element is coupled to a lace of the shoe, and the heel element comprises a fulcrum configured to provide a lever for moving the heel element relative to the upper when the wearer pulls the lace, wherein the lace passes from a first eyelet of the upper to the fulcrum, wherein the lace further passes from the fulcrum to a second eyelet of the upper, and wherein:

each of the first eyelet, the fulcrum, and the second eyelet is disposed on a lateral side of the shoe; or each of the first eyelet, the fulcrum, and the second eyelet is disposed on a medial side of the shoe.

2. The shoe of claim 1, wherein the upper does not comprise a heel portion.

3. The shoe of claim 1, wherein the heel element overlaps with the upper at a lateral and medial side of the upper.

4. The shoe of claim 1, wherein the upper comprises a heel portion and the heel element is arranged inside of the upper, wherein the heel element comprises an inward facing surface and an opposing outward facing surface, wherein a majority of the outward facing surface is not connected to the heel portion of the upper such that a void is formed between the outward facing surface of the heel element and the heel portion of the upper.

5. The shoe of claim 4, wherein at least a portion of the lace is tucked into the void.

6. The shoe of claim 1, wherein the fulcrum is positioned on a rear-half portion of the heel element.

7. The shoe of claim 6, wherein the fulcrum is positioned rearward of a rearmost portion of a tongue of the shoe.

8. The shoe of claim 1, wherein the heel element further comprises a lace guide.

9. The shoe of claim 8, wherein the lace guide is positioned on an outward facing surface of the heel element and adjacent to an inward facing surface of a heel portion of the upper.

10. The shoe of claim 9, wherein the fulcrum is positioned on the outward facing surface of the heel element and adjacent to the inward facing surface of the heel portion of the upper.

11. The shoe of claim 8, wherein the lace passes from the first eyelet of the upper, via the lace guide, to the fulcrum.

12. The shoe of claim 1, wherein a distance between the fulcrum and the second eyelet of the upper decreases as the wearer pulls the lace.

13. The shoe of claim 12, wherein the distance ranges from 30 mm to 50 mm when the heel element is in an unactivated state.

14. The shoe of claim 8, wherein each of the first eyelet, the lace guide, the fulcrum, and the second eyelet comprises a loop, webbing, lug, or punch hole.

15. The shoe of claim 1, wherein the fulcrum is a first fulcrum, and wherein the heel element comprises a second fulcrum on a side opposite to the first fulcrum.

16. The shoe of claim 8, wherein the lace guide is a first lace guide, and wherein the heel element comprises a second lace guide on a side opposite to the first lace guide.

17. The shoe of claim 1, wherein the heel element is configured to articulate forward when the lace is pulled.

18. A shoe comprising:

an upper; and a heel element arranged at least partially overlapping with at least a part of the upper, wherein:

the heel element is configured to envelop at least a part of a heel of a wearer of the shoe, the heel element is movable with respect to the upper, the heel element is coupled to a lace of the shoe, the heel element comprises a fulcrum configured to provide a lever for moving the heel element relative to the upper when the wearer pulls the lace, and the heel element comprises a lace guide, wherein the lace passes from a first eyelet of the upper, via the lace guide, to the fulcrum.

* * * * *